US007896665B2

(12) United States Patent
Parrish

(10) Patent No.: US 7,896,665 B2
(45) Date of Patent: Mar. 1, 2011

(54) STACKABLE ELECTRICAL PANEL MODULES

(75) Inventor: Joseph Edward Parrish, Goldsboro, NC (US)

(73) Assignee: Cooper Technologies Company, Houston, TX (US)

( * ) Notice: Subject to any disclaimer, the term of this patent is extended or adjusted under 35 U.S.C. 154(b) by 78 days.

(21) Appl. No.: 12/196,995

(22) Filed: Aug. 22, 2008

(65) Prior Publication Data

US 2010/0048039 A1 Feb. 25, 2010

(51) Int. Cl.
*H01R 13/44* (2006.01)

(52) U.S. Cl. ..... 439/133; 439/924.2; 439/142

(58) Field of Classification Search ..... 439/131, 439/133, 142, 924.1, 924.2, 541.5
See application file for complete search history.

(56) References Cited

U.S. PATENT DOCUMENTS

| | | | | |
|---|---|---|---|---|
| 4,767,347 | A * | 8/1988 | Kamp et al. | 439/133 |
| 4,845,593 | A | 7/1989 | Brown et al. | 361/192 |
| 4,955,821 | A | 9/1990 | Bernardini | 439/133 |
| 5,017,147 | A * | 5/1991 | Sugiyama et al. | 439/144 |
| 5,571,023 | A | 11/1996 | Anthony | 439/142 |
| 5,600,108 | A | 2/1997 | Newham | 200/50.28 |
| 6,796,814 | B1 | 9/2004 | Handschke | 439/142 |
| 2010/0048039 | A1 * | 2/2010 | Parrish | 439/55 |
| 2010/0048047 | A1 * | 2/2010 | Parrish | 439/142 |

* cited by examiner

*Primary Examiner* — James Harvey
(74) *Attorney, Agent, or Firm* — King & Spalding LLP

(57) ABSTRACT

An electrical panel assembly comprised of individual electrical panel modules. The electrical panel modules comprise a first receptacle comprising transmitting electrical contacts to interface with a first connector comprising receiving electrical contacts and a first rotation ring for facilitating contact between the transmitting electrical contacts and the receiving electrical contacts, where the first rotation ring rotates between an open position permitting connection or disconnection of the first connector from the receptacle and a closed position preventing connection or disconnection of the first connector from the first receptacle. The first electrical panel module interacts with a second electrical panel module in a manner that the absence of the first connector in the first receptacle prevents the second electrical panel module from accepting a second connector.

19 Claims, 25 Drawing Sheets

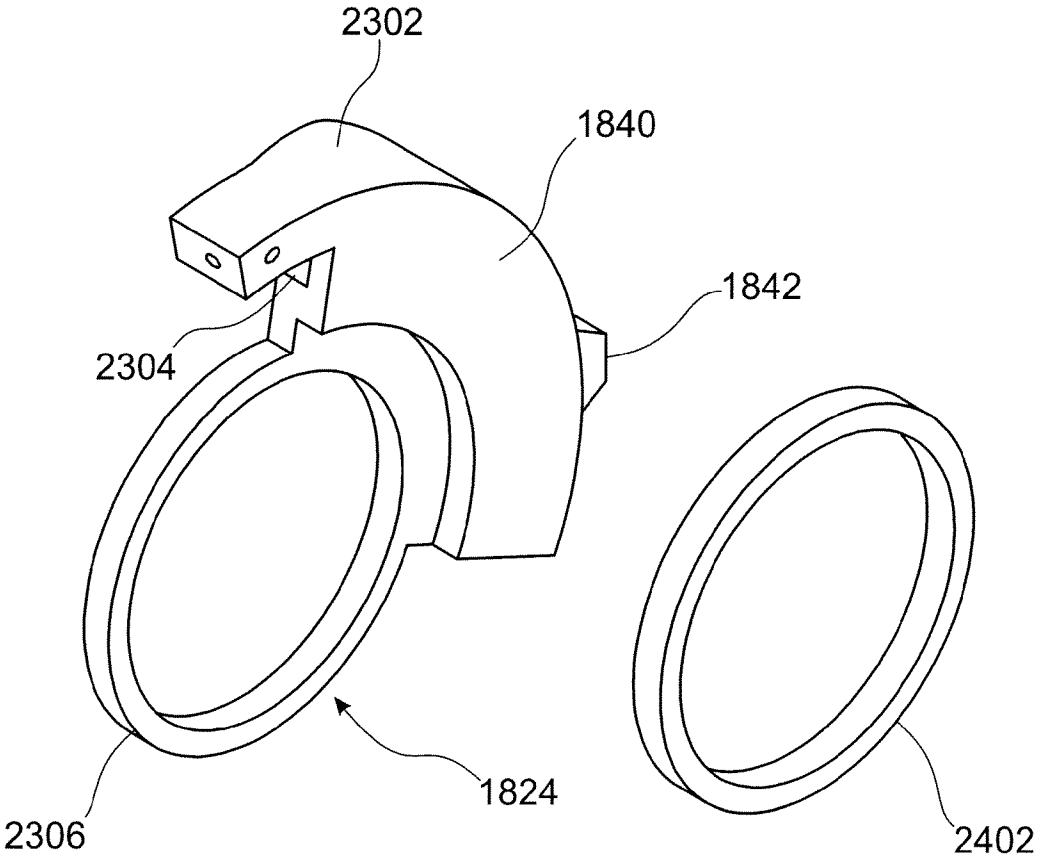
FIG. 24
FIG. 23
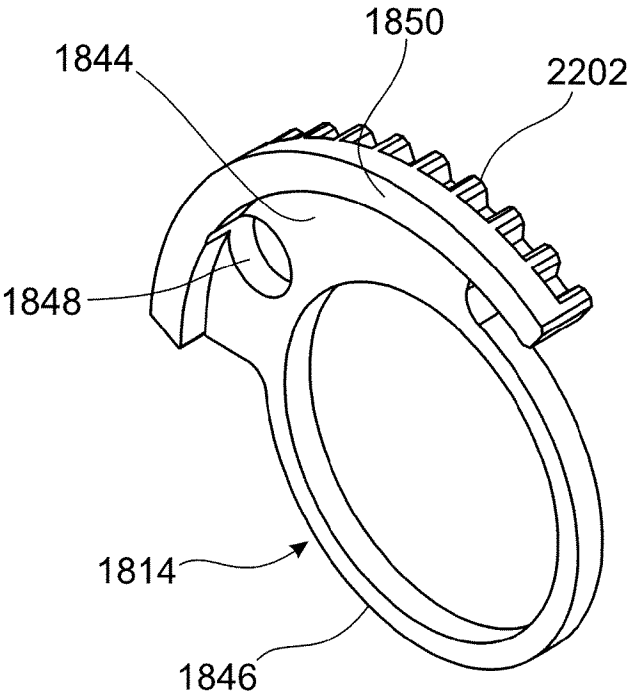
FIG. 22

STACKABLE ELECTRICAL PANEL MODULES

CROSS REFERENCE TO RELATED APPLICATIONS

This application is related to U.S. patent application Ser. No. 12/197,036, entitled, Stackable Electrical Panel Modules, and filed Aug. 22, 2008. The entire disclosure of the above-identified related application is hereby fully incorporated herein by reference.

TECHNICAL FIELD

The disclosed apparatus relates generally to electrical panels to connect electrical devices to power sources. Specifically, this application relates to technology that allows users to create an electrical panel from component modules to meet individual requirements.

BACKGROUND

To protect equipment and personnel when working with single conductor connectors, electrical connectors are attached and removed from electrical panels in a particular order. For example, where a ground connector is used, the ground connector is connected first and disconnected last. Typical electrical panel assemblies include three receptacles (comprising a ground, a neutral, and a live receptacle) or five receptacles (comprising a ground, neutral, and three separate live receptacles). Previous electrical panel assemblies have been limited by the number of receptacles the manufacturer decides to place in an electrical panel assembly. Due to the power requirements of some applications, previous electrical panel assemblies might not fit into one of these preexisting categories.

One conventional solution uses an electrical panel assembly with more than the needed number of receptacles where the unused receptacles are sealed or otherwise made non-functional. Another conventional solution requires a manufacturer to make an electrical panel assembly to the user's unique specifications, which could be both expensive and time consuming.

Therefore, a need exists for an electrical panel assembly that fits the individual needs of the user without customization or alteration of an existing electrical panel assembly.

SUMMARY

The disclosed apparatus relates generally to electrical panel assemblies. More particularly, the disclosed apparatus relates to a modular apparatus having individual modules that may be interconnected to form an electrical panel assembly. The assembly can maintain standards of electrical safety while allowing previously unavailable flexibility. The disclosed apparatus forces electrical connectors to be attached and detached from an electrical panel assembly in a particular order. The electrical panel assembly also may prevent a protective cover over the next receptacle module from being opened before a connector is installed in a preceding module.

The electrical panel assembly invention can require the connectors to be attached to and detached from their respective receptacles in a given order. The electrical panel assembly can serve either as an input panel or as an output panel and can be used in electrical systems requiring multiple receptacles.

According to one exemplary aspect, an electrical panel assembly comprises a first electrical panel module comprising a first receptacle contained in the module to interface with a first connector. The first receptacle comprises a first rotation ring for the interface between the receptacle and the first connector. The first rotation ring moves between an open position and a closed position. The open position permits connection or disconnection of the first connector from the first receptacle. The closed position prevents connection or disconnection of the first connector from the first receptacle. The first electrical panel module interacts with a second electrical panel module in a manner that, absent connection of the first connector in the first receptacle, the ability of a second electrical panel module receptacle contained in the second electrical panel module can be prevented from connecting to a second connector.

According to another exemplary aspect, an electrical panel module is designed to link with a subsequent electrical panel module in series. The electrical panel module comprises a receptacle to interface with a connector. A rotation ring is provided for an interface between the receptacle and the connector. The rotation ring moves between an open position that permits connection or disconnection of the connector from the receptacle and a closed position that prevents connection or disconnection of the connector from the receptacle. A tab interlock interfaces with a subsequent electrical panel module in series.

The disclosed apparatus can provide a module that can connect with other modules to form an electrical panel assembly. Each module comprises a receptacle that can accept a connector. Each module comprises various safety mechanisms that prevent improper use once the modules are assembled as an electrical panel assembly. Aspects of the disclosed apparatus include a mechanism that may prevent a receptacle from accepting a connector unless the previous module in series has a connector in its receptacle. This feature may prevent removal of a connector from a module until the subsequent module in sequence has already had a connector removed. This feature enforces the safety requirement that ground connections should be made first and disconnected last. Another aspect includes a lock that may prevent a protective cover from opening to expose the receptacle until the receptacle of the previous module has a connector inserted therein.

According to another exemplary aspect, an electrical panel assembly comprises a first electrical panel module comprising a first receptacle to interface with a first connector. A first rotation ring facilitates contact between the first receptacle and the first connector. The first rotation ring rotates in open position which permits connection or disconnection of the first connector from the receptacle. When the rotation ring is in a closed position, the first connector may not be connected or disconnected from the first receptacle. The first electrical panel module interacts with a second electrical panel module in a manner such that the absence of the first connector in the first receptacle prevents the second electrical panel module from accepting a second connector.

According to another aspect of an exemplary embodiment, an electrical panel module comprises a module casing that provides a housing for the electrical panel module and is designed to link with a subsequent electrical panel modules in series. The module casing further comprises a receptacle to interface with a connector and a rotation ring for facilitating contact between the receptacle and the connector, where the rotation ring moves between an open position permitting connection or disconnection of the connector from the receptacle and a closed position preventing connection or disconnection of the connector from the receptacle. A tab interlock is operably coupled to interface with the rotation ring and interfaces with a subsequent electrical panel module. Each module casing comprises one or more openings to facilitate internal interconnectivity with a subsequent electrical power module via the tab interlock.

These and other aspects, objects, features, and embodiments of the present disclosure will become apparent to those skilled in the art upon consideration of the following detailed description of illustrated embodiments exemplifying the best mode for carrying out the apparatus as presently perceived.

BRIEF DESCRIPTION OF THE DRAWINGS

The present apparatus may be better understood by reading the following description of non-limitative, exemplary embodiments with reference to the attached drawings, wherein like parts of each of the figures are identified by the same reference character, and which are briefly described as follows.

FIG. 8 comprises FIGS. 8A-8C.

FIG. 22 is an angular perspective view of the tab cam interlock of FIG. 19 according to an exemplary embodiment.

FIG. 23 is an angular perspective view of the cover cam interlock of FIG. 19 according to an exemplary embodiment.

FIG. 24 is an angular perspective view of a spacer according to an exemplary embodiment of FIG. 19 according to an exemplary embodiment.

DETAILED DESCRIPTION OF THE INVENTION

Figure 1:
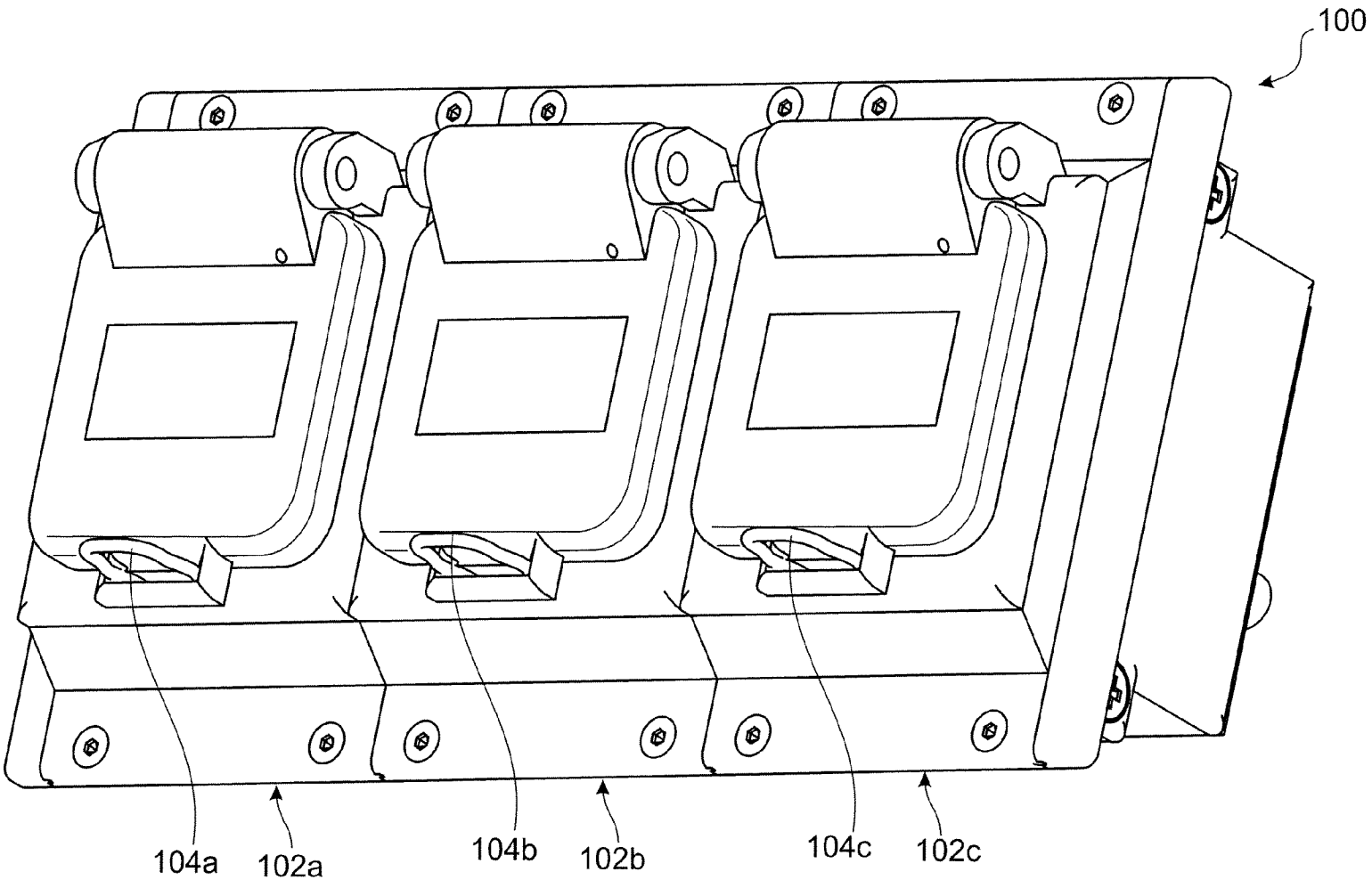
FIG. 1 is a perspective view of a fully assembled electrical panel assembly comprising three electrical panel modules according to an exemplary embodiment.

The disclosed apparatus may be better understood by reading the following description of non-limiting embodiments with reference to the attached drawings, wherein like parts in each of the figures are identified by the same reference characters.

FIG. 1 is a perspective view of a fully assembled electrical panel assembly 100 comprising three electrical panel modules 102*a-c* according to an exemplary embodiment. Alternative embodiments may have an unlimited number (two or more) of electrical panel modules 102 connected to each other, as will be explained below.

Each electrical panel module 102 has multiple moving parts. For illustrative purposes, all elements that shift position have a first position and a second position. The first position occurs when the respective element has not been acted on. The second position occurs when the element has been acted on. In several figures, the associated views are from the rear of the modules. As a result, while numbering typically runs from left to right, the numbering of modules in those figures viewed from the rear perspective will be from right to left to account for the perspective of the figures.

Figure 2:
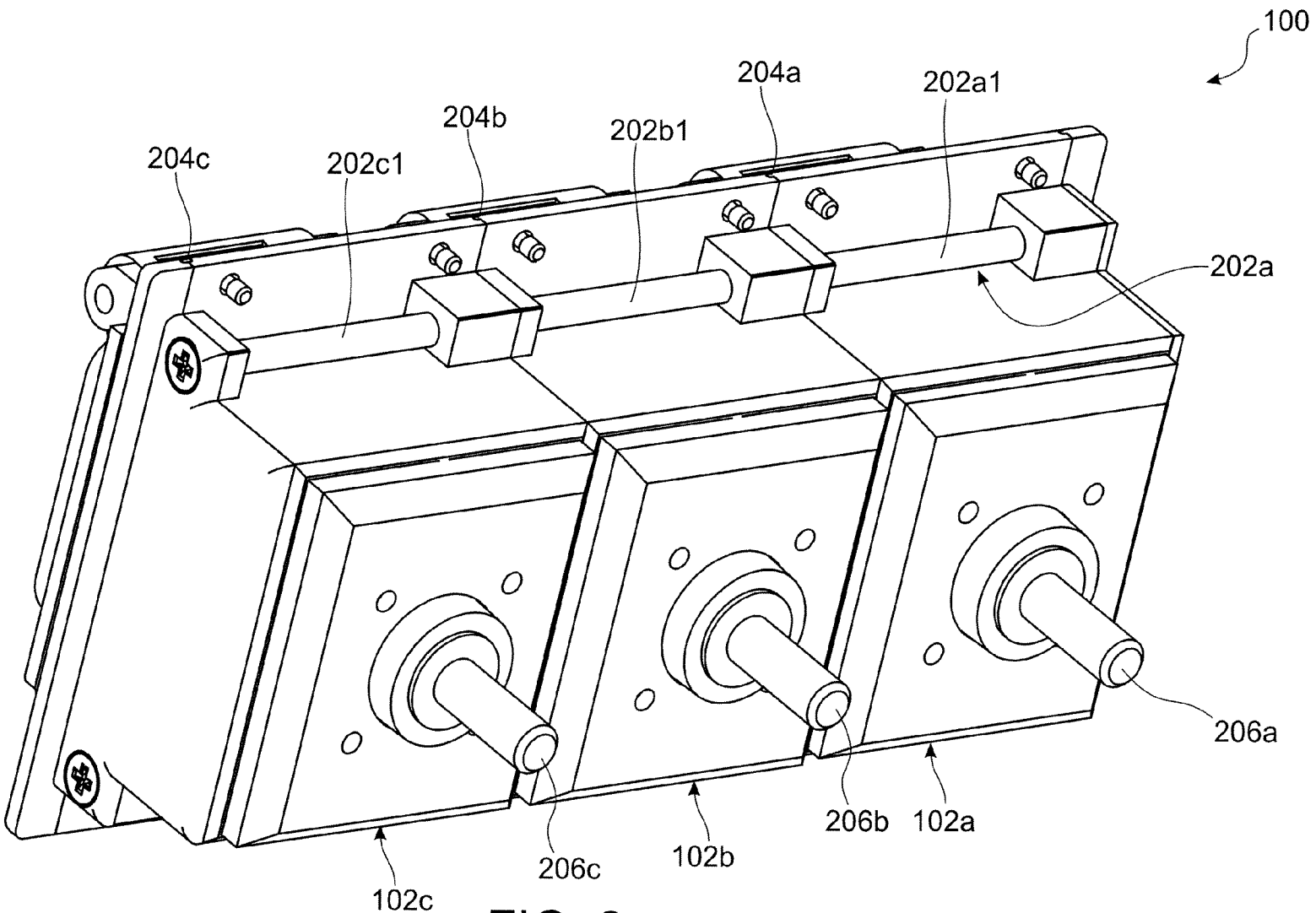
FIG. 2 is a rear perspective view of the electrical panel assembly of FIG. 1.
Figure 4:
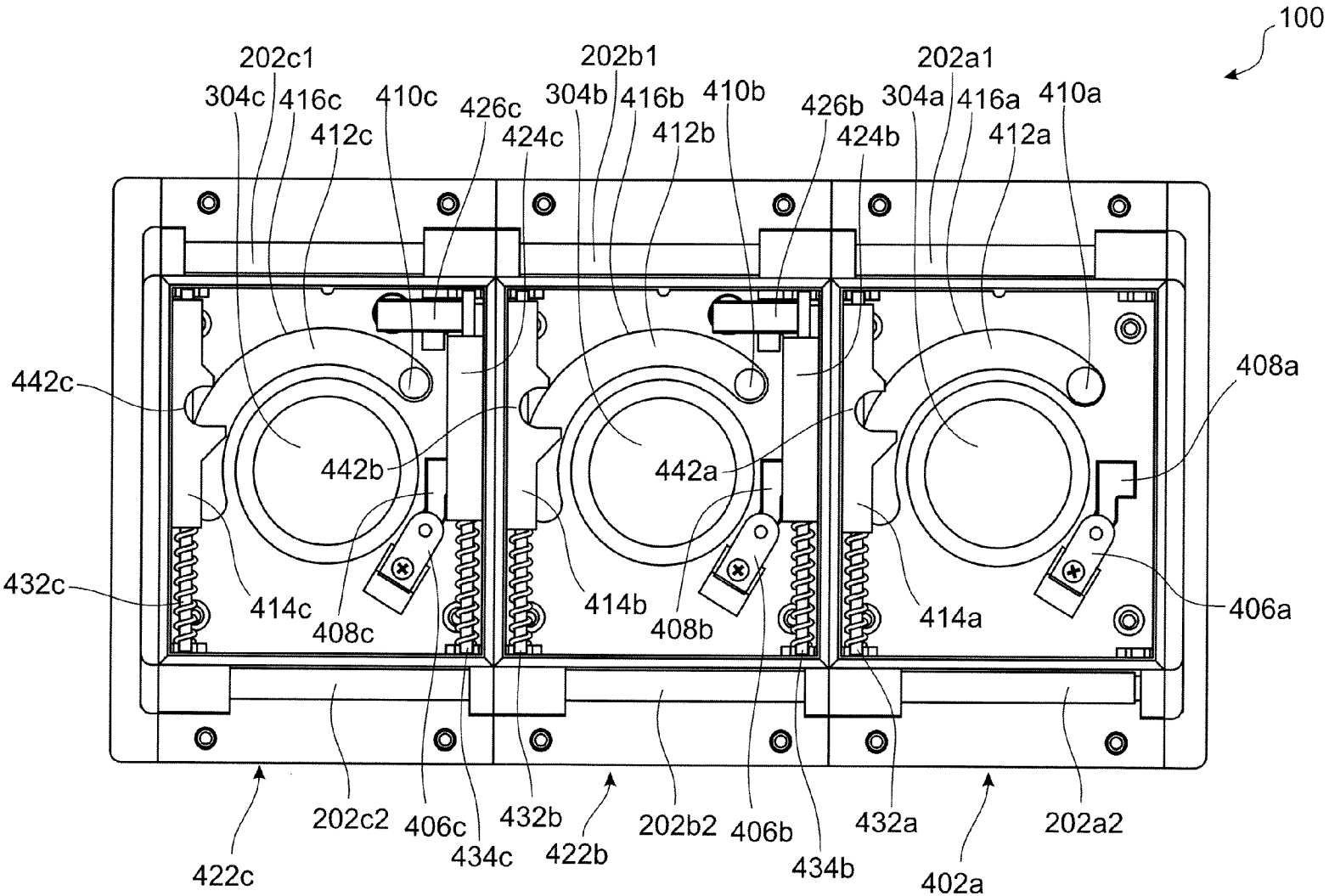
FIG. 4 is a rear internal view of the electrical panel assembly of FIG. 1, illustrating the interconnectivity of one ground electrical panel module and two non-ground electrical panel modules according to an exemplary embodiment.

FIG. 2 is a perspective view of the rear of the fully assembled, exemplary electrical panel assembly 100 from FIG. 1. Structural connections between the electrical panel modules 102*a-c* in the exemplary embodiment are strengthened by use of stackable metallic joining rods 202*a*1-*c*1 and 202*a*2-*c*2 as shown in FIG. 2, wherein the stackable metallic joining rods 202*a*2-*c*2 on the underside are obscured in FIG. 2. Stackable metallic joining rods 202*a*2-*c*2 are illustrated in FIG. 4. These stackable metallic joining rods 202*a*1-*c*1 and 202*a*2-*c*2 interconnect and strengthen the bond between the electrical panel modules 102*a-c* by fixing and aligning the electrical panel modules 102*a-c* to each other. The electrical panel modules 102*a-c* each hold a section of the connector rod 202*a*1-*c*1 and 202*a*2-*c*2. The connector rod 202*a*1 comprises a female threaded portion that is adjacent to a male threaded portion of connector rod 202*b*1. The connector rods 202*a*1 and 202*b*1 are coupled together to form a single rod holding the modules 102*a* and 102*b* together. This process is continued with connector rod 202*b*1 and 202*c*1 and also for connector rods 202*a*2-*c*2. An additional feature that aids in integrating the electrical panel modules 102*a-c* are the tongue and groove seals 204*a-c* that aid in the integrity of the electrical panel modules 102*a-c*. Electrical terminals 206*a-c* project from the rear of the modules 102*a-c* to allow the electrical panel modules 102*a-c* to be electrically coupled to a power source (not shown).

Figure 3B:
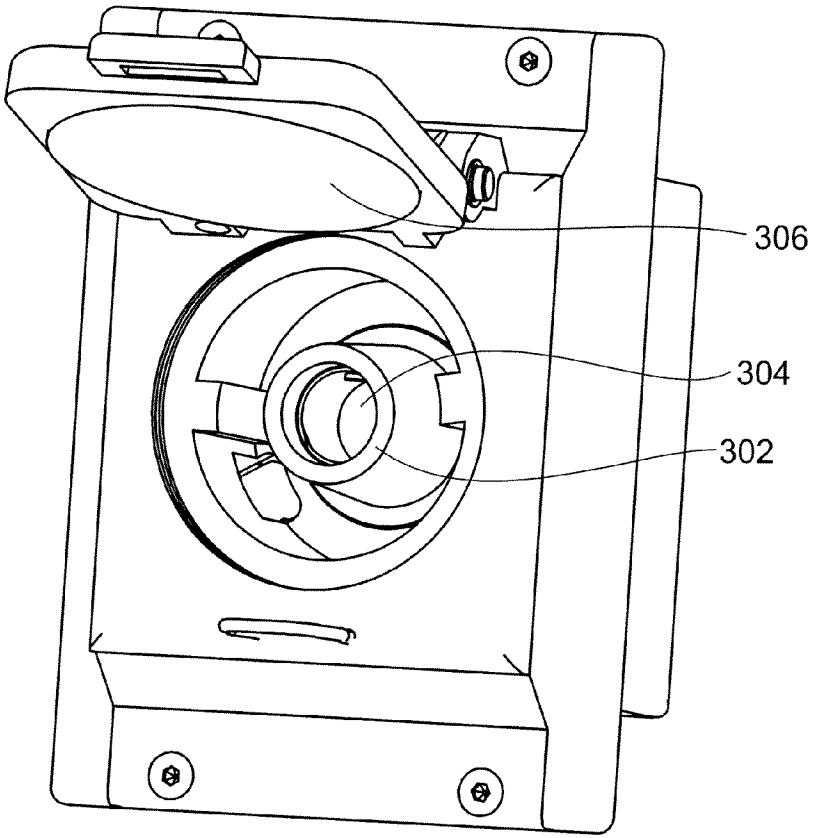
FIG. 3B is a perspective view of the individual electrical panel module of FIG. 3A.
Figure 3A:
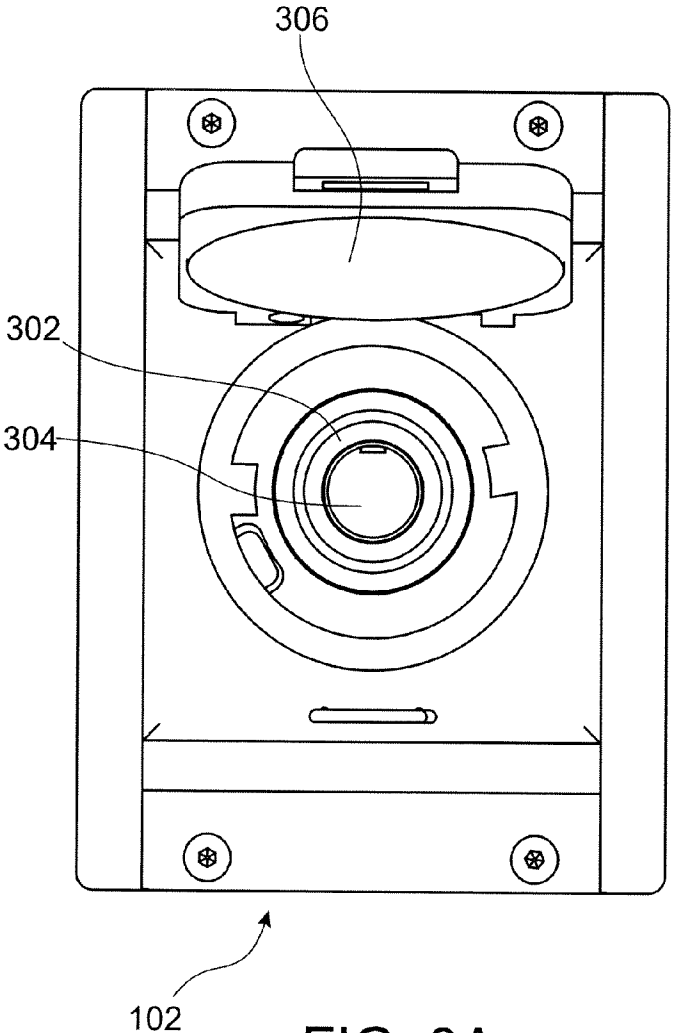
FIG. 3A is an front elevation view of an individual electrical panel module with a cover opened to reveal a receptacle according to an exemplary embodiment.

FIG. 3A is an front elevation view of an individual electrical panel module 102 with a cover 306 opened to reveal a receptacle 302 according to an exemplary embodiment. FIG. 3B is a perspective view of the exemplary electrical panel module 102 illustrated in FIG. 3A. FIGS. 3A-3B illustrate how the cover 306 conceals the receptacle 302, which comprises an aperture 304 for a connector (not shown) to be installed. The cover 306 in FIG. 3A is in an open position allowing access to the receptacle 302. As will be described below, the connector couples to the receptacle 302, thereby creating a secure connection.

In an exemplary embodiment, the connectors are dimensioned to fit within the apertures 304 of the electrical panel modules 100 and comprise receiving electrical contacts that are sized to interface with transmitting electrical contacts in the electrical panel modules 102*a-c* when installed by rotating the connectors into second position. With a connector installed in a receptacle 302, the individual elements of the electrical panel module 102 are manipulated, as described hereinafter. Although referred to herein as receiving electrical contacts of the connector and transmitting electrical contacts of the module 102, the transmitting and receiving functions of those items can be reversed without departing from the scope and spirit of the present invention.

Figure 5:
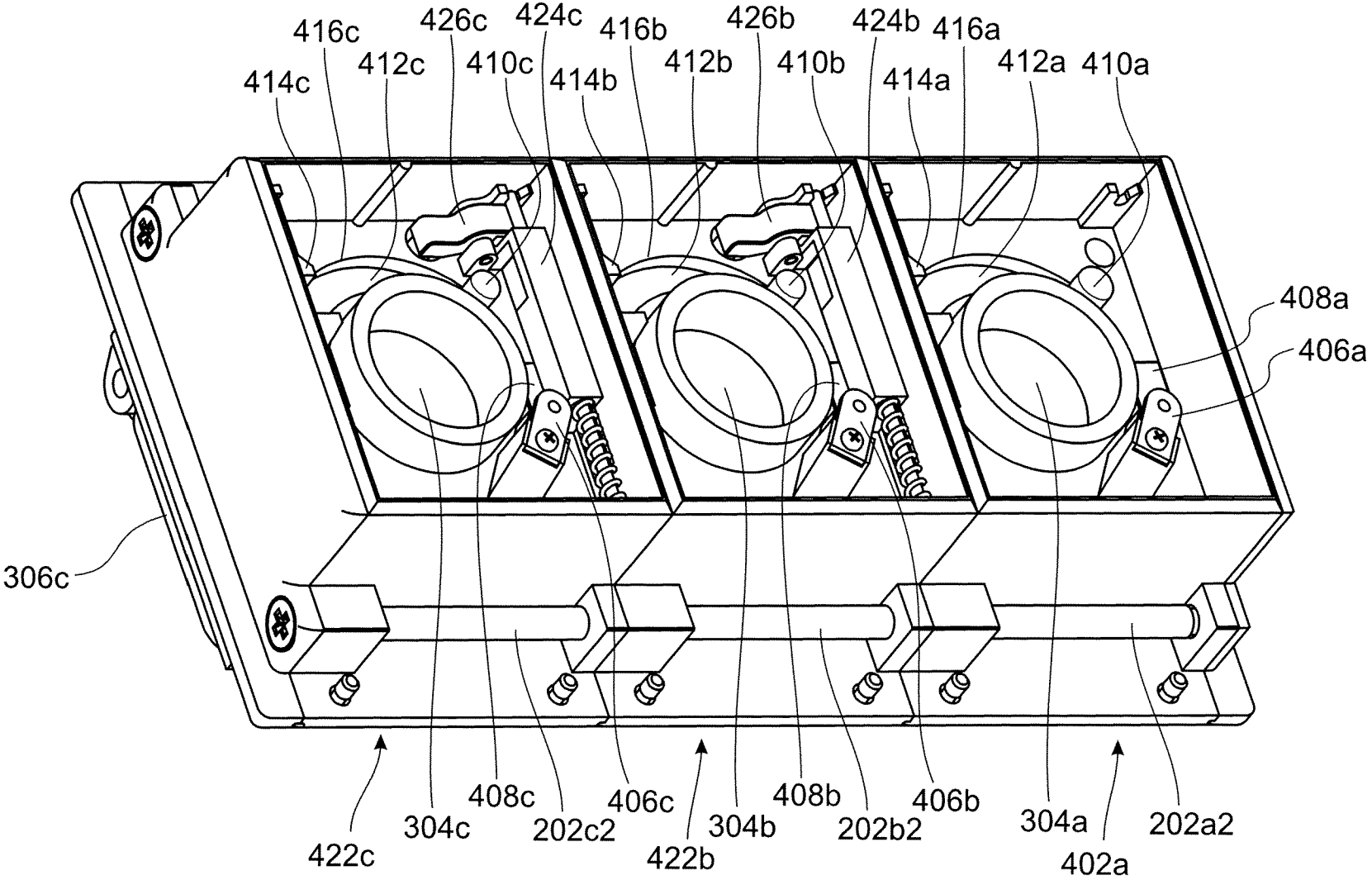
FIG. 5 is a perspective, internal view of the assembly of FIG. 4.

FIG. 4 is a rear internal view of the electrical panel assembly 100 of FIG. 1, illustrating the interconnectivity of one ground electrical panel module 402*a* and two non-ground electrical panel modules 422*b-c* according to an exemplary embodiment. FIG. 5 is a perspective view of the assembly 100 from FIG. 4. Elements will be referred to from right to left due to the view being from the rear perspective. Referring to FIGS. 1 and 4, the rear view of ground module 402*a* corresponds to module 102*a*, the rear view of non-ground module 422*b* corresponds to module 102*b*, and the rear view of non-ground module 422*c* corresponds to module 102*c*. The ground electrical panel module 402*a*, and its components referenced in FIGS. 4-5, will be described hereinafter with reference to FIGS. 6, 8, and 9. The non-ground electrical panel modules 422*b-c*, and their components referenced in FIGS. 4-5, will be described hereinafter with reference to FIG. 7-9.

Figure 6:
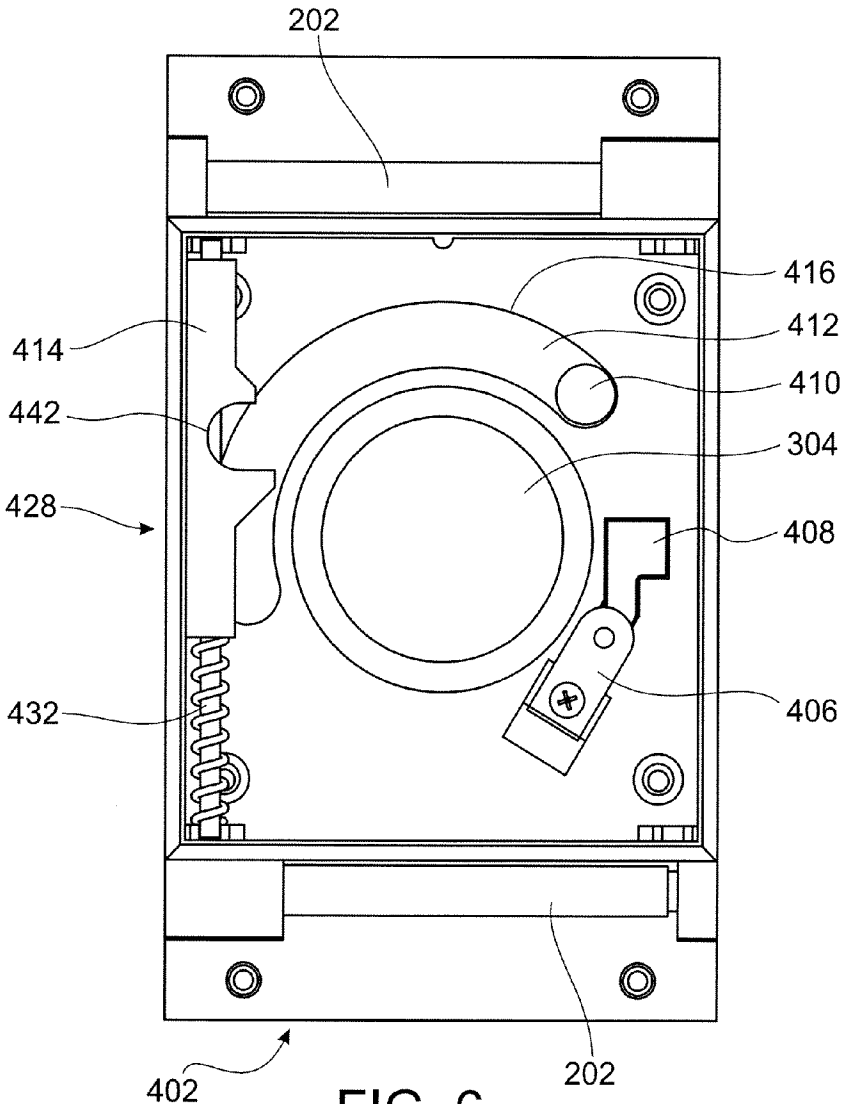
FIG. 6 is a rear elevation view of an electrical panel module configured for use as a ground electrical panel module according to an exemplary embodiment.

FIG. 6 is a rear elevation view of an electrical panel module 102 configured for use as a ground electrical panel module according to an exemplary embodiment. The ground electrical panel module 402 comprises an aperture 304. Surrounding the aperture 304 is a rotation ring 412 having a rotation ring tab 410 and being disposed in a rotation channel 416, where the rotation ring tab 410 interfaces with a tab interlock 414. A plug rotate lock 408*a* fixes the rotation ring 412 in a first position until an electrical connector (not shown) is installed in the aperture 304. A plug rotate lock spring 406 biases the plug rotate lock 408 in the first position when a connector is not inserted. The tab interlock 414 stays in the first position (as illustrated) when a connector is not installed due to the bias force of an attached interlock spring 432 until acted upon by the rotation ring tab 410.

As illustrated in FIGS. 3A and 3B, the ground electrical panel module 402 includes a cover 306 that obstructs entry into the aperture 304 as shown in FIG. 3*a*. In an exemplary embodiment, the ground electrical panel module 402 allows the cover 306 to open without restrictions. Alternatives will be explained below.

The insertion of the connector into the aperture 304 acts on the plug rotate lock 408 by applying a lateral force on the plug rotate lock 408 that overcomes the force of the plug rotate lock spring 406. The insertion of the connector into the aperture 304 moves the plug rotate lock 408 out of the first position to the second position. When the plug rotate lock 408 moves into the second position, the rotation ring 412 surrounding the aperture 304 is free to rotate about the aperture 304. In an exemplary embodiment, a spring can hold the rotation ring 412 in a first position until the connector placed in the aperture 304 is rotated to force the rotation ring 412 to rotate. The user turns the inserted connector in the freed rotation ring 412 until the rotation ring 412 reaches a second position corresponding to an opposite end of the rotation channel 416.

In an exemplary embodiment, the rotation ring 412 can operate in parallel with a cam lock (not shown) that secures the connector to the receptacle 302 and holds the transmitting electrical contact of the elemental panel module 402 to interact with the receiving electrical contact of the connectors. The receptacle 302 comprises a rivet (not shown) that interacts with the connector by way of a cam cut into the connector. As the connector is inserted into the receptacle 302 and rotated, the rivet interacts with the cam in the connector and couples the connector to the receptacle 302. This rotation will continue until the connector is fixed in a position allowing electrical coupling. Additionally, the action of the cam locking causes the receiving electrical contacts of the connector to expand inside the receptacle 302. The coupling of the transmitting and receiving electrical connectors allows power to flow from the electrical panel modules 402 to a device coupled to the connector. In an exemplary embodiment, the cam locks are designed to engage when the rotation ring 412 completes rotating, which is approximately 180 degrees. In an exemplary embodiment, the connectors are designed to have the receiving contacts of the connectors electrically couple with the transmitting contacts of the electrical panel module at or before rotation completes.

Before the rotation ring tab 410 encounters the tab interlock 414, the tab interlock 414 is held in position by the tab interlock spring 432. The tab interlock 414 reaches the second position when the rotation ring tab 410 moves through the rotation channel 416 and fully engages the tab interlock 414 by the rotation tab 410 entering the tab interlock groove 442 as the rotation ring 412 rotates. A tab interlock opening 428 as shown in FIG. 8 is provided adjacent to the tab interlock 414 where the tab interlock 414 can link through the tab interlock opening 428 to another electrical panel module 102, as will be described below.

Figure 7:
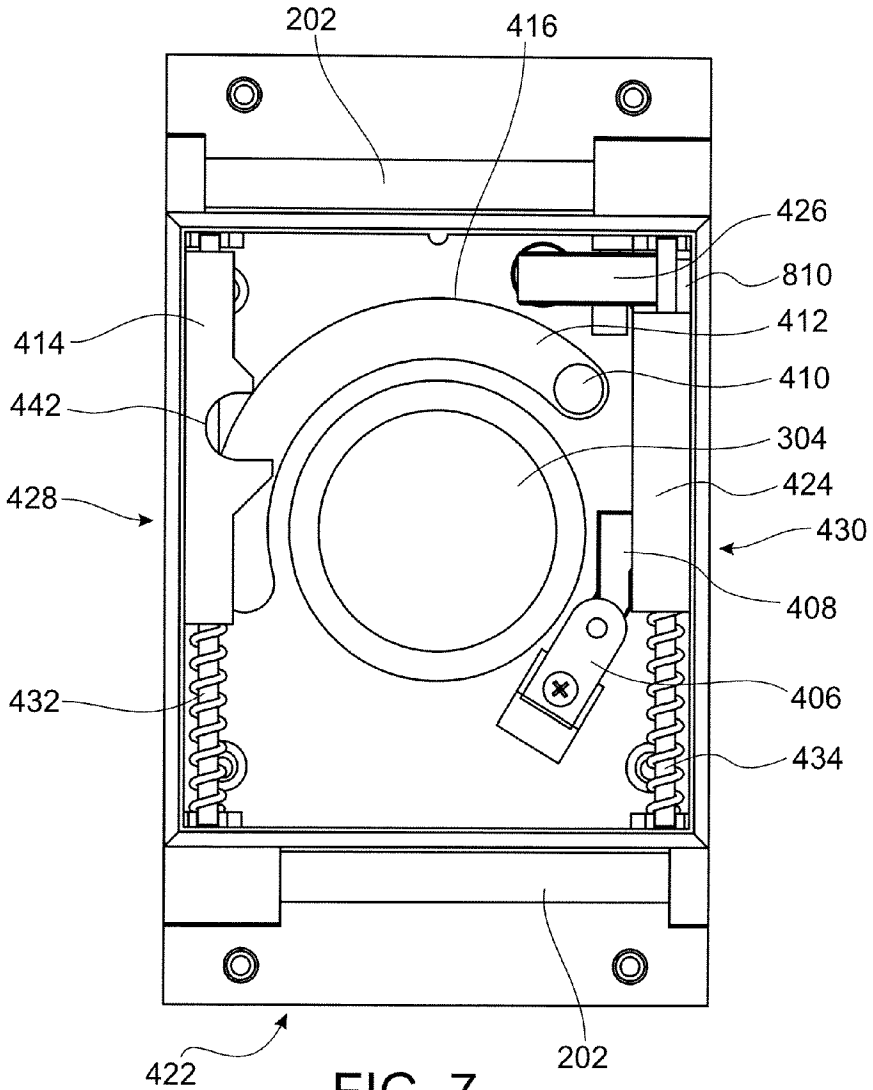
FIG. 7 is a rear elevation view of an electrical panel module configured for use as a non-ground electrical panel module according to an exemplary embodiment.

FIG. 7 is a rear elevation view of an electrical panel module 102 configured for use as a non-ground electrical panel module 422 according to an exemplary embodiment. FIG. 7 includes several additional elements from the ground electrical panel module 402. The non-ground electrical panel module 422 further comprises a cover interlock 424 held in a first position (as illustrated) by a cover interlock spring 434. The cover interlock 424 interfaces in a manner to be described below with the tab interlock 414 of the preceding ground electrical panel module 402 in a manner that allows the cover interlock 424 to be manipulated by either the tab interlock 414 of the preceding ground electrical panel module 402, a tab interlock 414 of a preceding non-ground electrical panel module 422, or the plug rotate lock 408. In the first position, the cover interlock 424 prevents the cover 306 for the non-ground electrical panel module 422 from opening by restricting a cover jam 426, preventing the cover jam 426 from withdrawing from the cover 306. In the exemplary embodiment, the cover jam 426 is a solid member that projects from the interior of the non-ground electrical panel module 422 into the cover 306 and prevents the cover 306 from rotating about the hinge when the cover interlock 424 acts on the cover jam 426. In this embodiment, the cover 306 of the receptacle 302 of the non-ground electrical panel module 422 may not be opened until the cover jam 426 is released by a slide 810 coupled to the cover interlock 424. As long as the cover jam 426 is unable to release, the cover 306 attached to the non-ground electrical panel module 422 may not be opened, thereby preventing connector entry to the receptacle 302 of the module 422. Adjacent to the cover interlock 424 is a cover interlock opening 430 shown in FIG. 8. As shown in FIG. 8, a tooth 804 of the cover interlock 424 projects through the cover interlock opening 430 to interface with a tab interlock 414 of a separate electrical panel module 102. The remaining elements herein operate as they did in the ground electrical panel module 402 and are numbered accordingly.

Figure 8B:
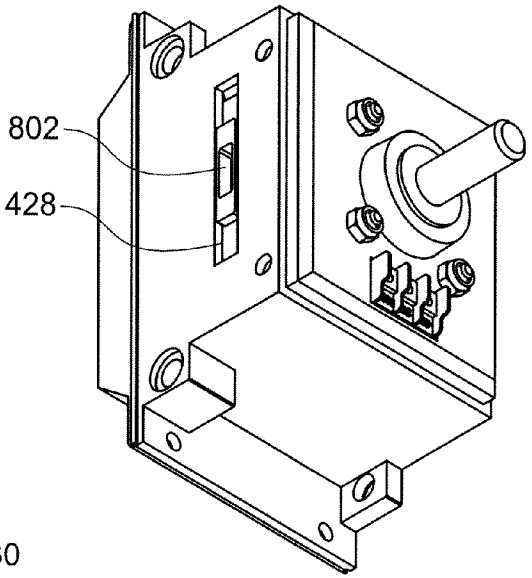
FIG. 8B is a rear perspective view of an electrical panel module showing a tab interlock aperture according to an exemplary embodiment.
Figure 8C:
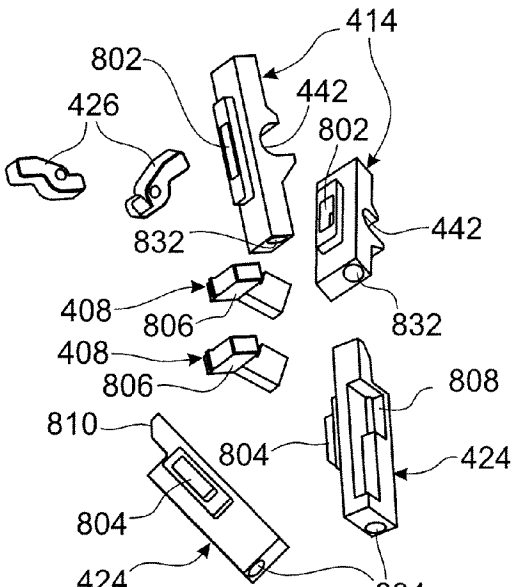
FIG. 8C is a perspective view of a series of elements of an electrical panel model according to an exemplary embodiment.
Figure 8A:
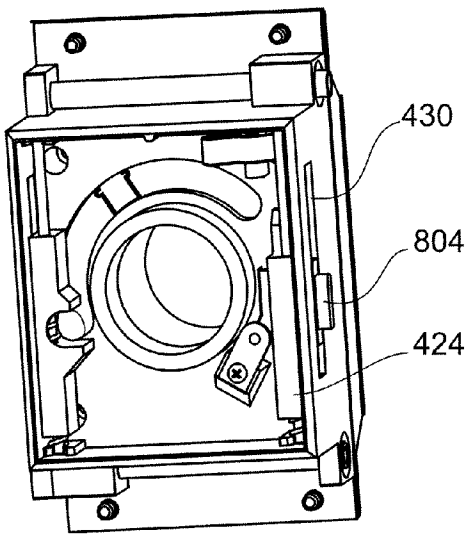
FIG. 8A is a rear perspective of an electrical panel model showing the cover interlock aperture according to an exemplary embodiment.

FIGS. 8A-C and 9 illustrate how various elements aid in interconnectivity between modules. FIG. 8A is a rear perspective view of an electrical panel module 102 showing the cover interlock aperture 430 according to an exemplary embodiment. The cover interlock aperture 430 allows the tooth 804 to extend outside the electrical panel module 442. FIG. 8B is a rear perspective view an electrical panel module 102 showing the tab interlock aperture 428 according to an exemplary embodiment. The tab interlock aperture 428 allows a cavity 802 of the tab interlock 414 to interface with a cover interlock 424 of an adjacent module.

FIG. 8*c* is a perspective view of a series of elements of an electrical panel module 102 according to an exemplary embodiment. Tab interlocks 414 comprise a cavity 802 on a side opposite to the side having the groove 442. The cavity 802 corresponds to a tooth 804 on the cover interlock 424. The tooth 804 and cavity 802 interconnect the cover interlock 424 and tab interlock 414 of their respective modules. When a tab interlock 414 of a module moves to the second position, it forces the cover interlock 424 that it is connected to by means of the tooth 804 and cavity 402 into a second position. The tab interlock 414 further comprises a sleeve 832 that allows the translation from the first position to second position.

Cover interlock 424 comprise an indentation, a slide 810, and a tooth 804. The tooth 804 allows connectivity with an associated tab interlock 414. The indentation allows the plug rotate lock 408 to restrict the movements to the tab interlock 414. The slide allows the door jam 426 to be restricted. The cover interlock 424 further comprises a sleeve 834 that allows the translation from the first position to second position.

Another element is the plug rotate lock 408, which comprises a tab 806 that interconnects to an indentation 808 in the cover interlock 424 when a connector is inserted in an aperture 304.

Another element is the cover jam 426 that prevents the cover 306 over the aperture 304 from opening. Cover jam 426 interacts with the slide 810 in the cover interlock 424. When the cover interlock 424 is in the first position, the slide 810 restricts the cover jam 426 movement. When the cover interlock 424 is in second position, the cover jam 426 is free to release the cover 306.

Figure 9:
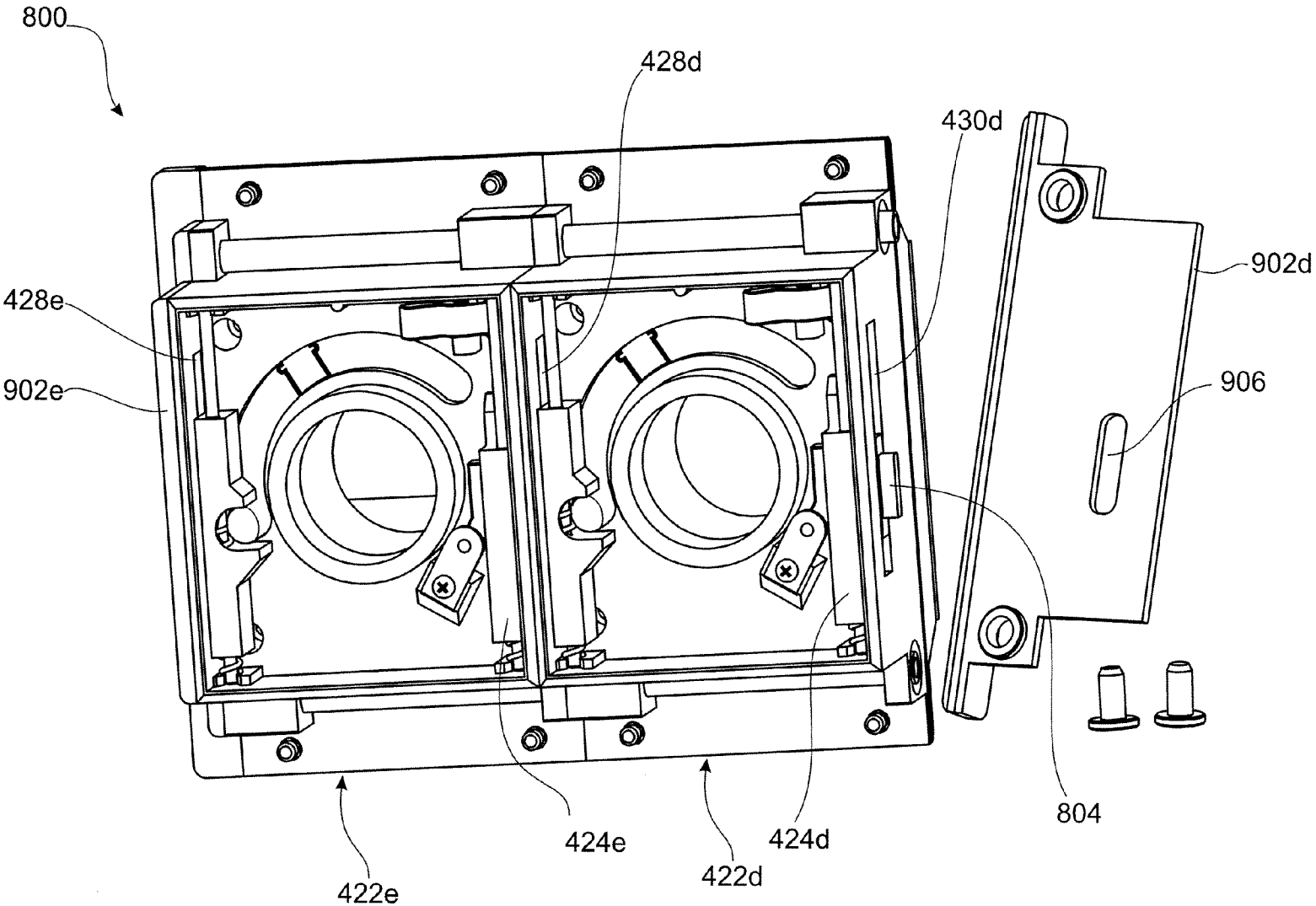
FIG. 9 is a rear perspective view of an electrical panel assembly comprising two non-ground electrical panel modules and having one side panel removed to illustrate how the first electrical panel module is fixed as a modified ground state module while also illustrating how the side panels maintain assembly integrity according to an exemplary embodiment.

FIG. 9 is a rear perspective view of an electrical panel assembly 800 comprising two non-ground electrical panel modules 422*d-e* and having one side panel, or end cap, 902 removed to illustrate how the first electrical panel module 422*d* is fixed as a modified ground state module while also illustrating how the side panels 902 maintain assembly integrity according to an exemplary embodiment. This exemplary embodiment utilizes two non-ground electrical panel modules 422*d-e*. Once the non-ground electrical panel modules 422*d-e* are linked in series, the leading edge of the non-ground electrical panel module 422*d* and the trailing edge of the non-ground electrical panel module 422*e* are not connected to other modules. In this embodiment, the side panel, or end cap, 902*e* covering the non-ground electrical panel module 422*e* covers the opening that allows the tab interlock 414*e* to move freely. At the same time, the side panel, or end cap, 902*d* covering non-ground electrical panel module 422*d* comprises a ground notch 906 that locks the cover interlock 424*d* in the second position. The ground notch 906 acts on the cover interlock 424*d* to release the cover jam 426*d* and the plug rotate lock 408*d*, mimicking the function of a ground electrical panel module 402. If a ground electrical panel module 402 is used, the side panel 902 could cover the empty cover interlock opening 430 of a module 402 where the absent cover interlock 424*d* would reside to maintain integrity.

The side panel 902 in exemplary embodiments also creates the appearance of a single unit from the perspective of the user when the electrical panel modules 422*d-e* are assembled. In exemplary embodiments, the side panel 902 also can have portions that are oriented such that they are level with the front panels of electrical modules. This configuration gives the appearance of a single unit with a flange bordering the entire assembly, such as shown in FIG. 1.

The electrical panel module interconnectivity between the cover interlock 424 and the tab interlock 414 of different modules allows for the safety feature between connections, which necessitates having the ground connected first and disconnected last.

Although these embodiments show a particular set of mechanisms, alternatives to these mechanisms also may be used without departing from the scope and spirit of the exemplary embodiments. The interconnectivity to form an electrical panel assembly 100 may be accomplished by alternative communication means between the modules, including electronic communication between the modules controlling the restrictions described in the exemplary embodiment.

The interaction of the exemplary mechanisms will be explained by way of reference to FIG. 4. All of the elements described in FIGS. 6-9 will be referenced, where elements ending with an 'a' will refer to ground module 402*a*, elements ending with a 'b' will refer to non-ground module 422*b*, and elements ending with a 'c' will refer to non-ground module 422*c*.

As previously discussed with reference to FIG. 4, insertion of a connector though the aperture 304*a* of ground module 402*a* will overcome the force on the plug rotate lock spring 406*a* to release the plug rotate lock 408*a*, thereby allowing the rotation ring 412*a* to rotate with rotation of the connector. The rotation ring tab 410*a* will travel through the rotation channel 416*a* where it will engage with the tab interlock groove 442*a* and press the tab interlock 414*a* against the bias force of the tab interlock spring 432 into the second position. With the rotation ring 412*a* in the second position, the cam lock engages and fixes the connector to the receptacle 302*a*, as previously described.

Based on the design of the modules in the exemplary embodiment, the tab interlock 414*a* of ground module 402*a* interfaces with the cover interlock 424*b* of non-ground module 422*b*. The interface is accomplished via the connection of the tooth 804*b* of the cover interlock 424*b* to the cavity 802*a* of the tab interlock 414*a*. The connection between the tooth 804*b* and the cavity 802*a* occurs by the tooth 804*b* passing though the cover interlock aperture 430*b* of the non-ground module 422*b* and connecting to the cavity 802*a* visible through the tab interlock aperture 428*a* of the ground module 402*a*. With the tab interlock 414*a* of ground module 402*a* in the second position, the cover interlock 424*b* in the non-ground module 422*b* also enters the second position.

When the cover interlock 424*b* of non-ground module 422*b* enters the second position, the slide 810*b* is no longer adjacent to the cover jam 426*b*, thereby releasing the cover jam 426*b*. With the cover jam 426*b* released, the cover 306*b* obstructing the entrance to the receptacle 302*b* can now open, allowing a second connector to be inserted through the aperture 304*b*. The rotation ring 412*b* is held in the first position by a spring that cannot be counteracted until the second connector is installed. With the second connector installed, the rotation ring tab 410*b* will travel through the rotation channel 416*b* with rotation of the second connector, where it will engage with the tab interlock grove 442*b* and press the tab interlock 414*b* into the second position. With the rotation ring 412*b* and the tab interlock 414*b* in the second position, the cam lock engages and fixes the second connector to the receptacle 302*b*.

When the second connector is inserted into the aperture 304*b* of non-ground module 422*b*, the plug rotate lock 408*b* will be placed into the second position. The plug rotate lock 408*b* then interacts with a tab interlock 414*b* by connecting with indentation 808*b* in the tab interlock 414*b*, which allows the plug rotate lock 408*b* to keep the cover interlock 424*b* from returning to the first position. Until the plug rotate lock 408*b* returns to the first position, cover interlock 424*b* will be unable to return to the first position. The plug rotate lock 408*b* will not return to the first position until the connector has been removed from the aperture 304*b*. Due to the previously discussed connection between the tooth 804*b* of the cover interlock 424*b* and the cavity 802*a* of the tab interlock 414*a* of the ground module 402*a*, the tab interlock 414*a* in the ground module 402*a* cannot return to the first position, forcing the rotation ring 412*a* to stay in the second position, since the rotation ring tab 410*a* is held in place by the tab interlock groove 442*a* to force the connector to stay connected to the receptacle 302*a* in the ground electrical panel module 402. Thus, the ground connector in the ground module 402*a* cannot be removed until the second connector is removed from the non-ground module 422*b*.

The process from the non-ground module 422*b* continues in the non-ground module 422*c* based on the design of the exemplary embodiment. With the attachment of the second connector to the non-ground module 422*b*, the tab interlock 414*b* of the non-ground module 422*b* interfaces with the cover interlock 424*c* of the non-ground module 422*c*. The interface is accomplished via the connection of the tooth 804*c* of the cover interlock 424*c* to the cavity 802*b* of the tab interlock 414*b*. The connection between the tooth 804*c* and the cavity 802*b* occurs by the tooth 804*c* passing though the cover interlock aperture 430*c* of the non-ground module 422*c* and connecting to the cavity 802*b* visible through the tab interlock aperture 428*b* of the non ground module 422*b*. With the tab interlock 414*b* of non-ground module 422*b* in the second position, the cover interlock 424*c* in non-ground module 422*c* also enters the second position.

When the cover interlock 424*c* of non-ground module 422*c* enters the second position, the slide 810*c* is moved away from the cover jam 426*c*, thereby releasing the cover jam 426*c*. With the cover jam 426*c* released, the cover 306*c* obstructing the entrance to the aperture 304*c* can now open, allowing a third connector to be inserted through the aperture 304*c*. The rotation ring 412*c* is held in the first position by a spring that cannot be counteracted until the third connector is installed. The rotation ring tab 410*c* will travel through the rotation channel 416*c* with rotation of the third connector where it will engage with the tab interlock groove 442*c* and press the tab interlock 414*c* into the second position.

When the third connector is inserted into the aperture 304*c* of non-ground module 422*c*, the plug rotate lock 408*c* will be placed into the second position. The plug rotate lock 408*c* then interacts with the cover interlock 424*c* by connecting with the indentation 808*c* in the tab interlock 414*c*, which allows the plug rotate lock 408*c* to keep the cover interlock 424*c* from returning to the first position. Until the plug rotate lock 408*c* returns to the first position, cover interlock 424*c* will be unable to release. The plug rotate lock 408*c* will not return to the first position until the third connector has been removed from the aperture 304*c*. Due to the previously discussed connection between the tooth 804*c* of the cover interlock 424*c* and the cavity 802*b* of the tab interlock 414*b* of the non-ground module 422*b*, the tab interlock 414*b* in the non-ground module 422*b* cannot return to the first position, forcing the rotation ring 412*b* to stay in the second position since the rotation ring tab 410*b* is held in place by the tab interlock groove 442*b* to force the connector to stay connected to the receptacle 302*b* in the non-ground electrical panel module 422*b*. Thus, the second connector in the non-ground module

422*b* cannot be removed until the third connector is removed from the non-ground module 422*c*.

To disconnect the connectors from their respective receptacles 302, the connectors must be decoupled from the receptacles 302 in reverse order. In the exemplary embodiment, the tab interlock 414*c* of non-ground module 422*c* is not fixed in position, allowing the rotation ring 412*c* to return to the first position with rotation of the third connector to remove the third connector. When the third connector is removed from non-ground module 422*c*, the force acting on the plug rotate lock 408*c* is removed and the plug rotate lock 408*c* returns to the first position. With the plug rotate lock 408*c* in the first position, the plug rotate lock 408*c* is disengaged from the cover interlock 424*c* of non-ground module 422*c*.

With the release of the cover interlock 424*c* of non-ground module 422*c*, the tab interlock 414*b* of non-ground module 422*b* now may return to the first position. As a result of the tab interlock 414*b* of non-ground module 422*b* being able to return to the first position, the associated rotation ring 412*b* is now freely rotatable since the tab interlock groove 442*b* can release the rotating ring tab 410*b*. The rotation ring 412*b* is now rotated to the first position with rotation of the second connector to remove the second connector from non-ground module 422*b*. When the rotation ring 412*b* returns to the first position, the tab interlock spring 432*b* acting on the tab interlock 414*b* of non-ground module 422*b* and the cover interlock spring 434*c* acting on the cover interlock 424*c* of non-ground module 422*c* force both components back to the first position. With the cover interlock 424*c* of non-ground module 422*c* in the first position, the cover jam 426*c* of non-ground module 422*c* is engaged by the slide 810*c*, preventing the cover 306*c* of non-ground module 422*c* from opening and preventing a connector from being installed in the aperture 304*c*.

When the second connector is removed from non-ground module 422*b*, the force acting on the plug rotate lock 408*b* is removed and the plug rotate lock 408*b* returns to the first position. With the plug rotate lock 408*b* in the first position, the plug rotate lock 408*b* is disengaged from the cover interlock 424*b* of non-ground module 422*b*.

With the release of the cover interlock 424*b* of non-ground module 422*b*, the tab interlock 414*a* of ground module 402*a* now may return to the first position. As a result of the tab interlock 414*a* of ground module 402*a* being able to return to the first position, the associated rotation ring 412*a* is now freely rotatable since the tab interlock groove 442*a* can release the rotating ring tab 410*a*. The rotation ring 412*a* is now rotated to the first position with rotation of the first connector to remove the first connector from ground module 402*a*. When the rotation ring 412*b* returns to the first position, the tab interlock spring 432*a* acting on the tab interlock 414*c* of ground module 402*a* and the cover interlock spring 434*b* acting on the cover interlock 424*b* of non-ground module 422*b* force both components back to the first position. With the cover interlock 424*b* of non-ground module 422*b* in the first position, the cover jam 426*b* of non-ground module 422*b* is engaged by the slide 810*b*, thereby preventing the cover 306*b* of non-ground module 422*b* from opening and preventing a connector to be installed in the aperture 304*b*.

When the first connector is removed from ground module 402*a*, the force on the plug rotate lock 408*a* is removed. Since this is a ground module 402*a*, there is no other module on which to act. The cover 306*a* may still be opened for a new ground connector to be installed.

According to an exemplary embodiment, the ground module 402*a* and the non-ground modules 422*b-c* may include an additional safety feature that restricts the decoupling of connectors from their respective modules 402, 422. The cover jam 426 may be designed such that the cover jam 426 may not allow the cover interlock 424 to return to first position until the cover 306 is closed. As a result, a ground module 402 or a non-ground module 422 would not be able to release the associated connector unless the cover 306 of the subsequent module 422 is closed according to an exemplary embodiment. Such an exemplary embodiment is described hereinafter with reference to FIGS. 29-31.

According to an exemplary embodiment, a lock ring 104*a* (FIG. 1) may be attached to the cover 306*a*. When the cover 306*a* is closed, a locking mechanism may be attached to the lock ring 104*a* to prevent the cover 306*a* from opening. Based on an exemplary embodiment, when cover 306*a* cannot open, then none of the subsequent covers 306*b-c* can open. Additionally, lock rings 104 may be attached to any other cover 306 or module 102, which prevents the locked cover 306 and any subsequent cover 306 from being opened when externally locked.

Alternative embodiments may include an electrical panel assembly 100 wherein the first electrical panel module 102*a* may be a module other than a ground module 402. For example, a non-ground module 422 may be used as the first electrical panel module 102*a* in an electrical panel assembly 100, if desired.

Figure 10:
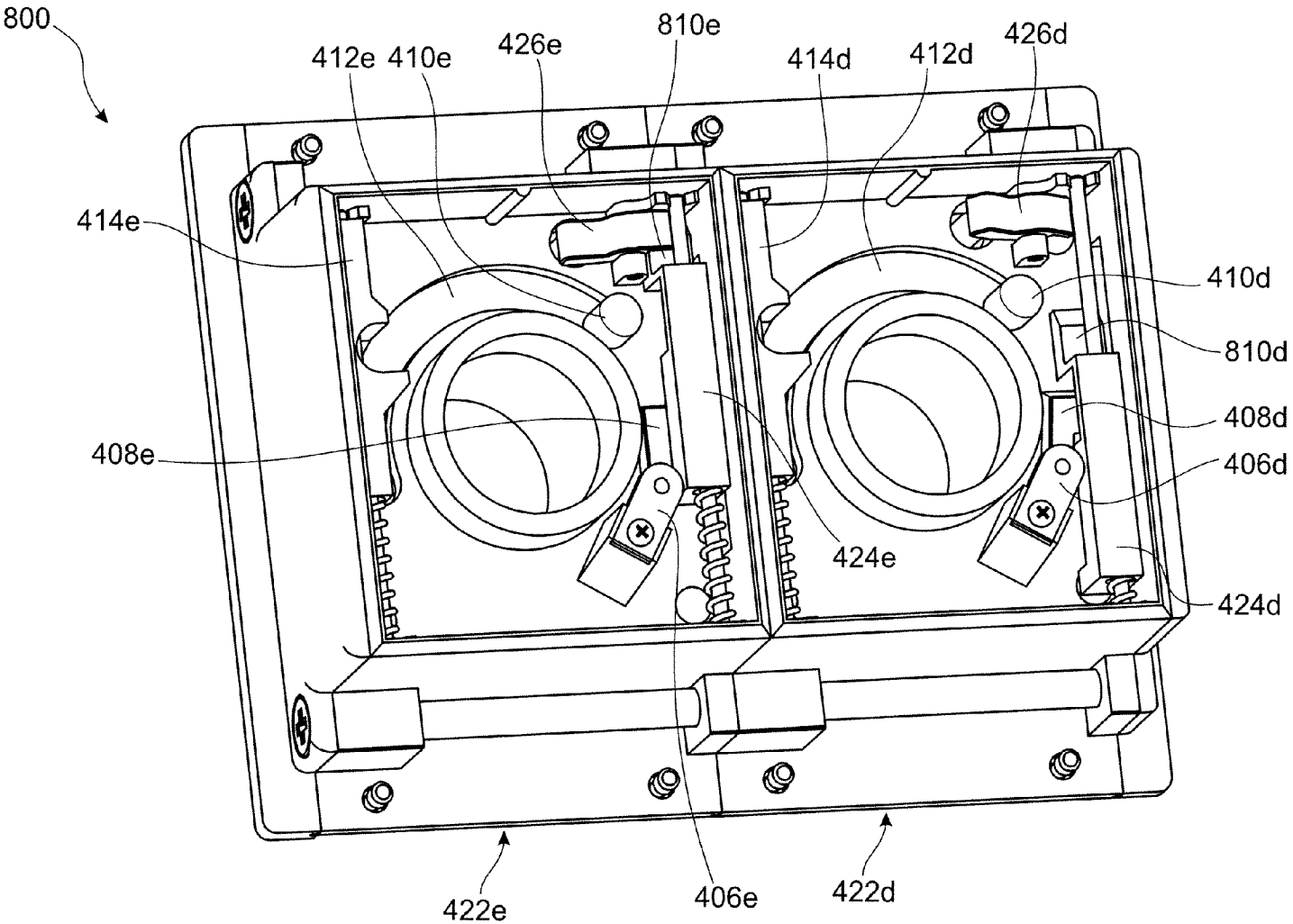
FIG. 10 is a rear perspective view of two electrical panel modules forming an electrical panel assembly where the first electrical panel module is configured as a ground module and the second electrical panel module is a non-ground module according to an exemplary embodiment.
Figure 11:
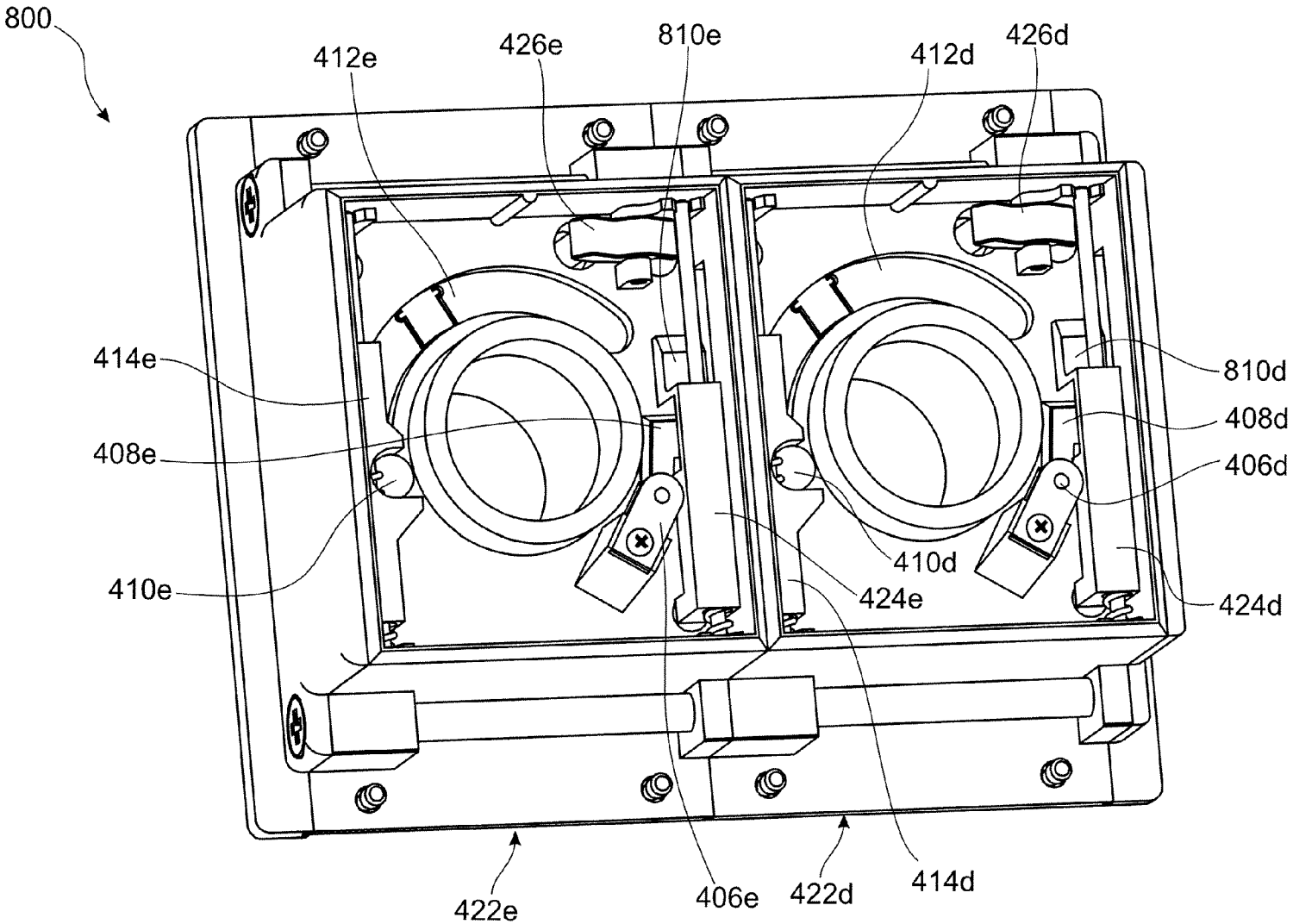
FIG. 11 is a rear perspective view of the electrical panel assembly of FIG. 10 and having connectors installed into the assembly according to an exemplary embodiment.

FIGS. 10 and 11 provide a perspective view of a two electrical panel module assembly 800. FIG. 10 is a perspective view of the rear of two electrical panel modules 422*d-e* forming the electrical panel assembly 800, where the electrical panel module 422*d* is configured as a ground module and the electrical panel module 422*e* is a non-ground module according to an exemplary embodiment. Module 422*d* is set to a ground configuration by use of a side panel 902*d*. Module 422*d* is connected to a second non-ground electrical panel module 422*e*. FIG. 10 shows module 422*d* with cover interlock 424*d* in the second position, releasing the cover jam 426*d*, but with the plug rotate lock 408*d*, rotation ring 412*d*, and tab interlock 414*d* in the first position. Non-ground electrical panel module 422*e* shows tab interlock 414*e* in the first position, with the plug rotate lock 408*e*, rotation ring 412*e*, and cover interlock 424*e* also in the first position. Module 422*d* is configured to accept a connector, while non-ground electrical panel module 422*e* currently may not accept a connector due to the cover jam 426*e* causing the cover to remain closed.

FIG. 11 is a rear perspective view of the electrical panel assembly 800 of FIG. 10 where the elements in second position as if the connectors have been installed. Module 422*d* and non-ground electrical panel module 422*e* have cover interlocks 424*d-e*, the cover jams 426*d-e*, and the cover rotate plug locks 408*d-e* all in the second position. The connector for non-ground electrical panel module 422*e* can be removed since nothing is restricting the tab interlock 414*e* in non-ground electrical panel 422*e*. However, as long as a connector is inserted in non-ground electrical panel module 422*e*, the cover interlock 424*e* of non-ground electrical panel 422*e* will remain fixed, preventing tab interlock 414*d* in module 422*d* from allowing the rotation ring 412*d* to release the connector in module 422*d*.

The electrical panel modules 102 are constructed from materials suited to use in the electrical industry. In an exemplary embodiment, materials will be used to make the electrical panel modules 102 lighter and more water resistant. The front panel may be made of stainless steel. Lip seals (not shown) on the covers and gaskets (not shown) protect the internal connections of the receptacles from exposure to water. Rotation rings 412 may also be watertight. O-rings provide seals for various components. Tongue and groove seals 204 provide protection between the side panels and the associated electrical panel modules. The side and rear casings can be constructed from synthetic material. An example would be fiberglass type plastics. Areas that need less strength could utilize micro-blend materials.

Figure 12:
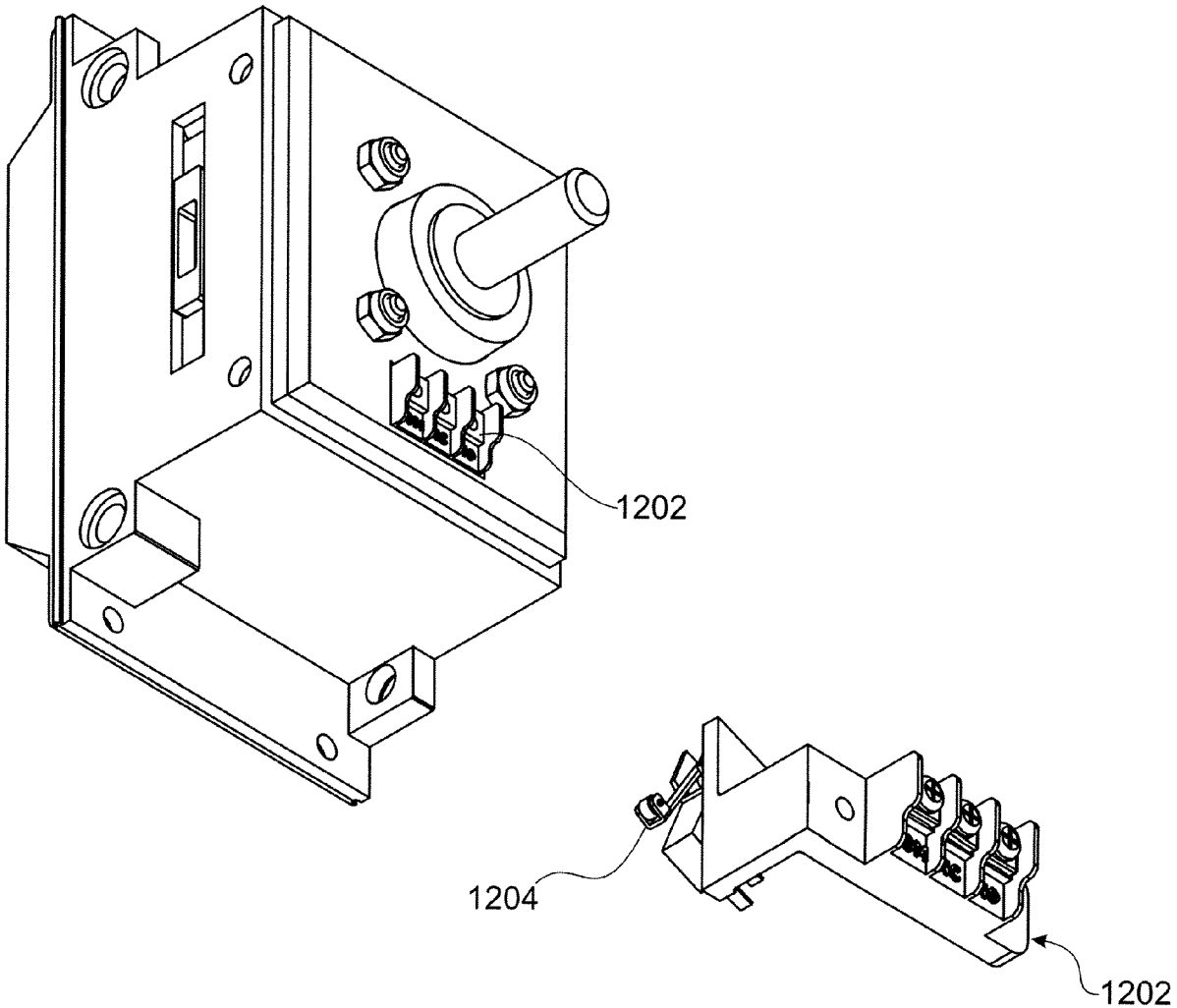
FIG. 12 is a perspective view of an module comprising a limit switch according to an exemplary embodiment.
Figure 13:
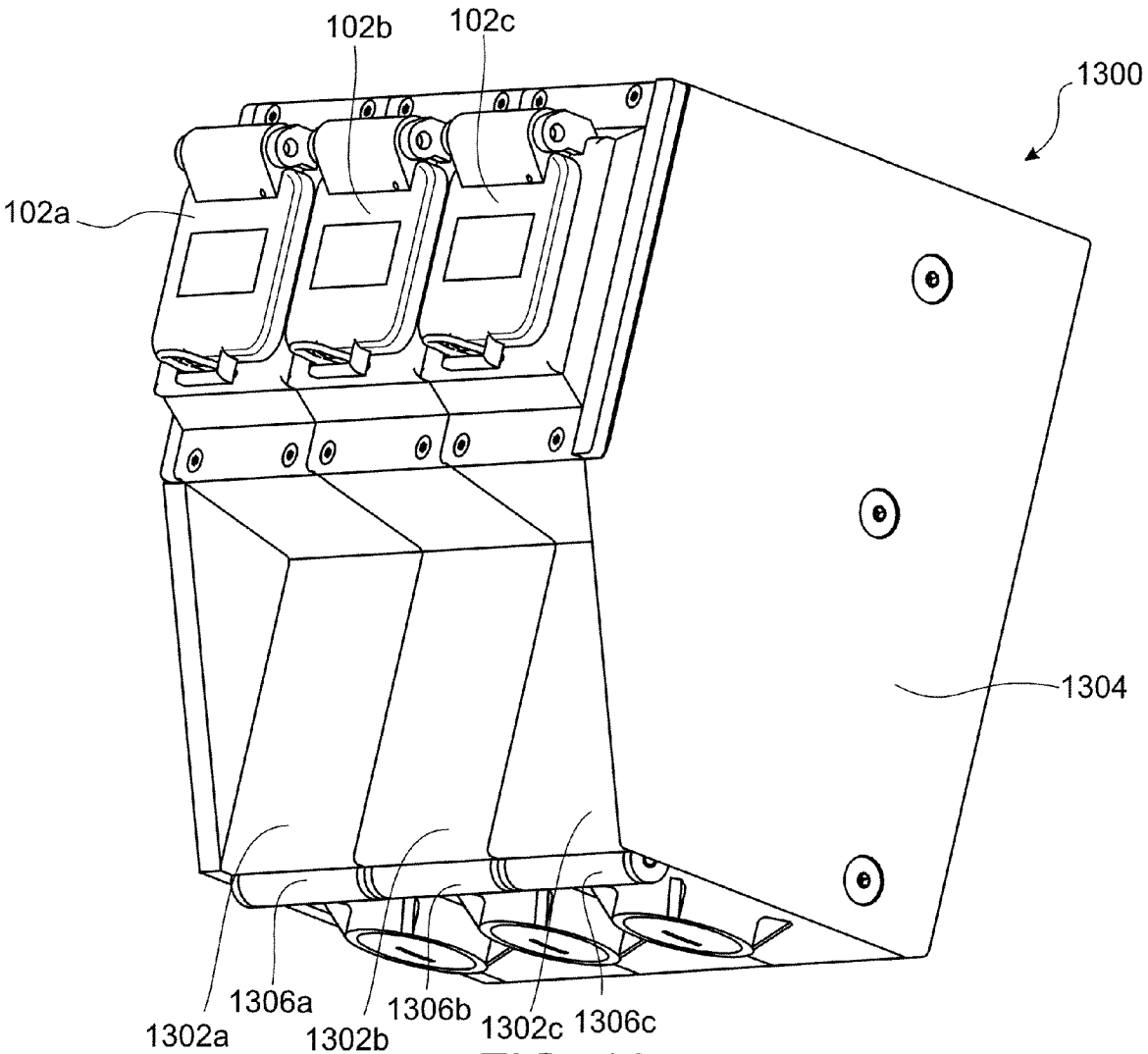
FIG. 13 is a perspective view of an assembly having individual electrical panel modules integrated with stackable electrical panels to form a stackable electrical panel assembly according to an exemplary embodiment.

FIG. 12 is a perspective view of an assembly 1200 comprising a limit switch 1202 according to an exemplary embodiment. A limit switch 1202 is an electrical device that can detect motion with respect to the respective electrical panel modules 102. In the exemplary embodiment, the limit switch 1202 has an arm 1204 that freely rotates. Such a limit switch 1202 would be used in the assembly where the unit is opened with a hinge 1306, as shown in FIG. 13 in a stackable panel assembly 1300 which will be discussed below. This limit switch 1202 can be set to interrupt power to the electrical panel modules 102 in the event the modules 102 are opened by detecting a rotation of, for example, forty five degrees or more about the hinges. One advantage in the use of a limit switch 1202 is that in the event a electrical panel assembly 1300 has to be opened to inspect the electrical panel modules 102, the limit switch 1202 detects those non-nominal positions to prevent shock to personnel.

The electrical panel modules 102 now connected in series can be installed in any location where an electrical panel assembly 100 would be used. This location can include being made a component of a preexisting electrical panel. Other examples include the completed unit being placed in a cavity in a wall or other configuration where the electrical panel modules 102 are visible.

FIG. 13 is a perspective view of an assembly 1300 having individual electrical panel modules 102*a-c* integrated with stackable electrical panels 1302*a-c* to form a stackable electrical panel assembly 1300 according to an exemplary embodiment. Each stackable electrical panel 1302 comprises an individual electrical panel module 102 and housing 1304 to hold the electrical panel module 102 independently of any previously existing support structure. These stackable electrical panels 1302 can be connected together to form a stackable panel assembly 1300 comprising the individual electrical panel modules 102. The stackable panel assembly 1300 comprises all the connections necessary to connect the individual electrical panel modules 102 and housings 1304 to their respective cables as shown in FIG. 13.

Figure 14B:
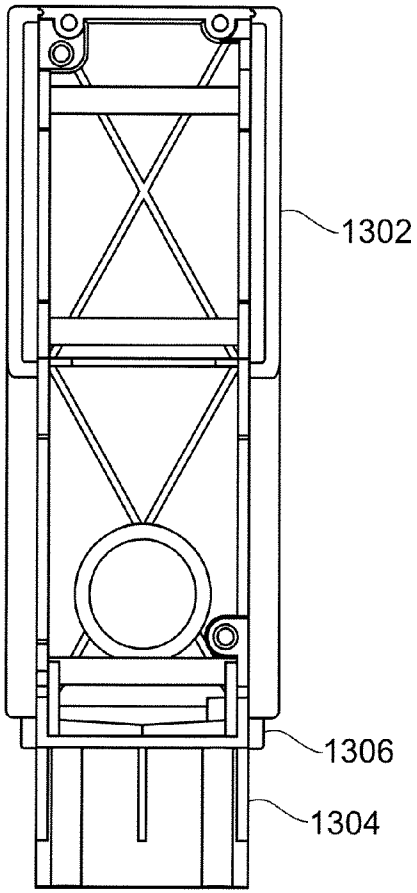
FIG. 14B is an elevation view of a housing of a stackable electrical panel illustrated in FIG. 13 according to an exemplary embodiment.
Figure 14A:
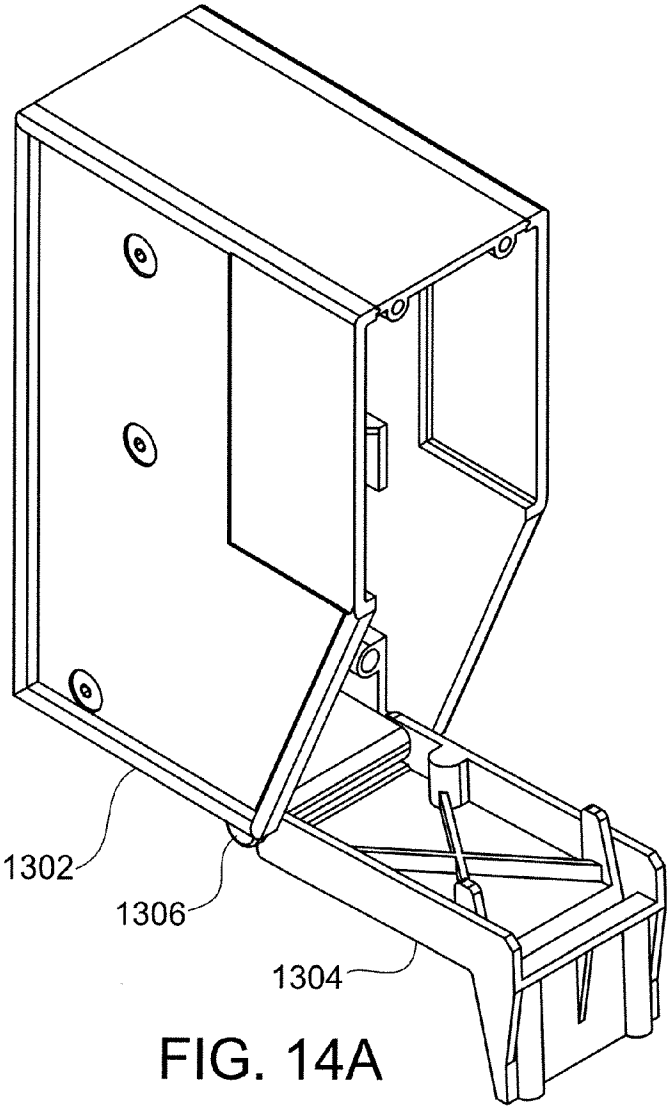
FIG. 14A is a perspective view of a housings of the stackable electrical panels illustrated in FIG. 13 according to an exemplary embodiment.
Figure 15:
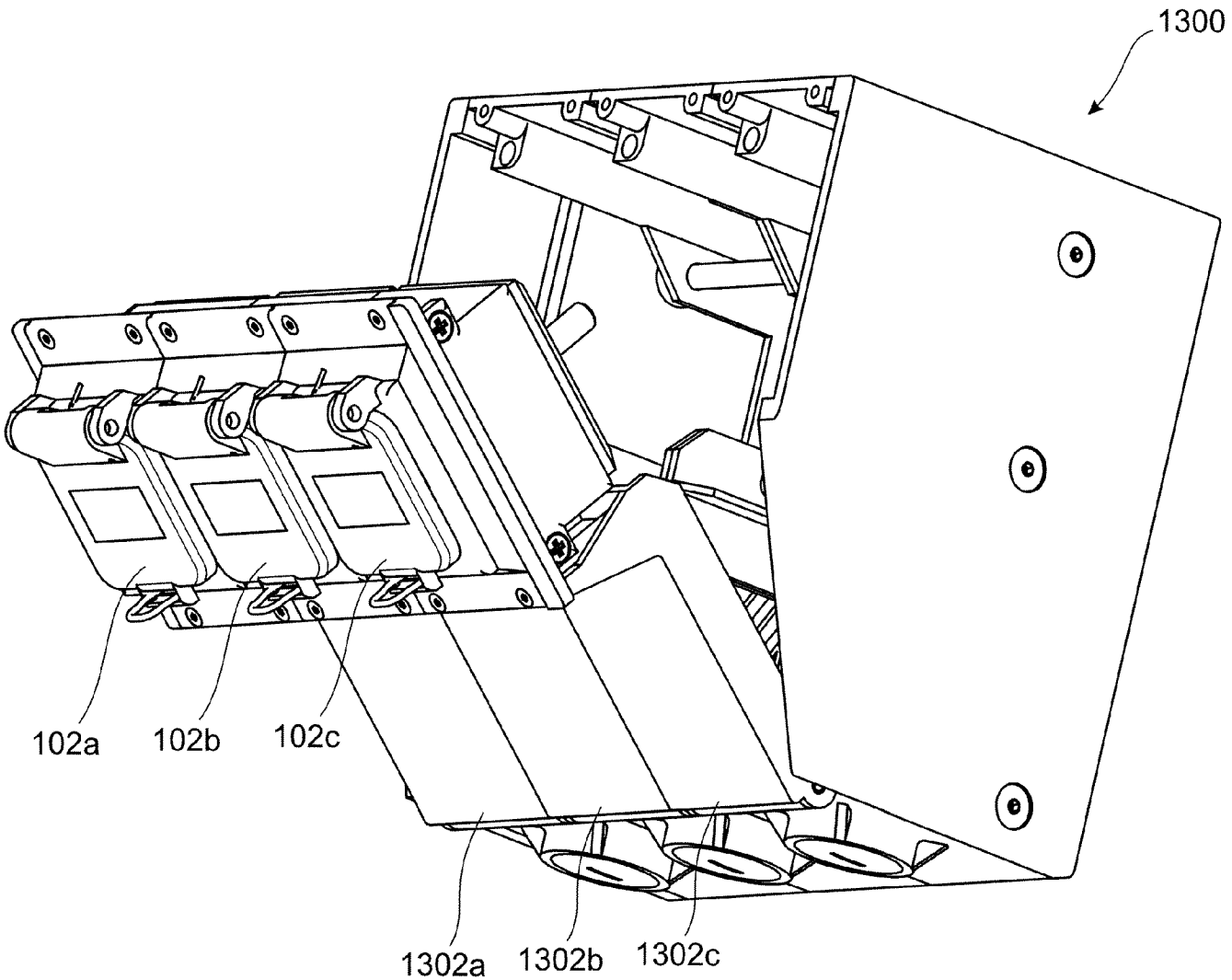
FIG. 15 is a perspective view of a stackable electrical panel assembly opened to allow a user to inspect the electrical panel modules according to an exemplary embodiment.
Figure 16:
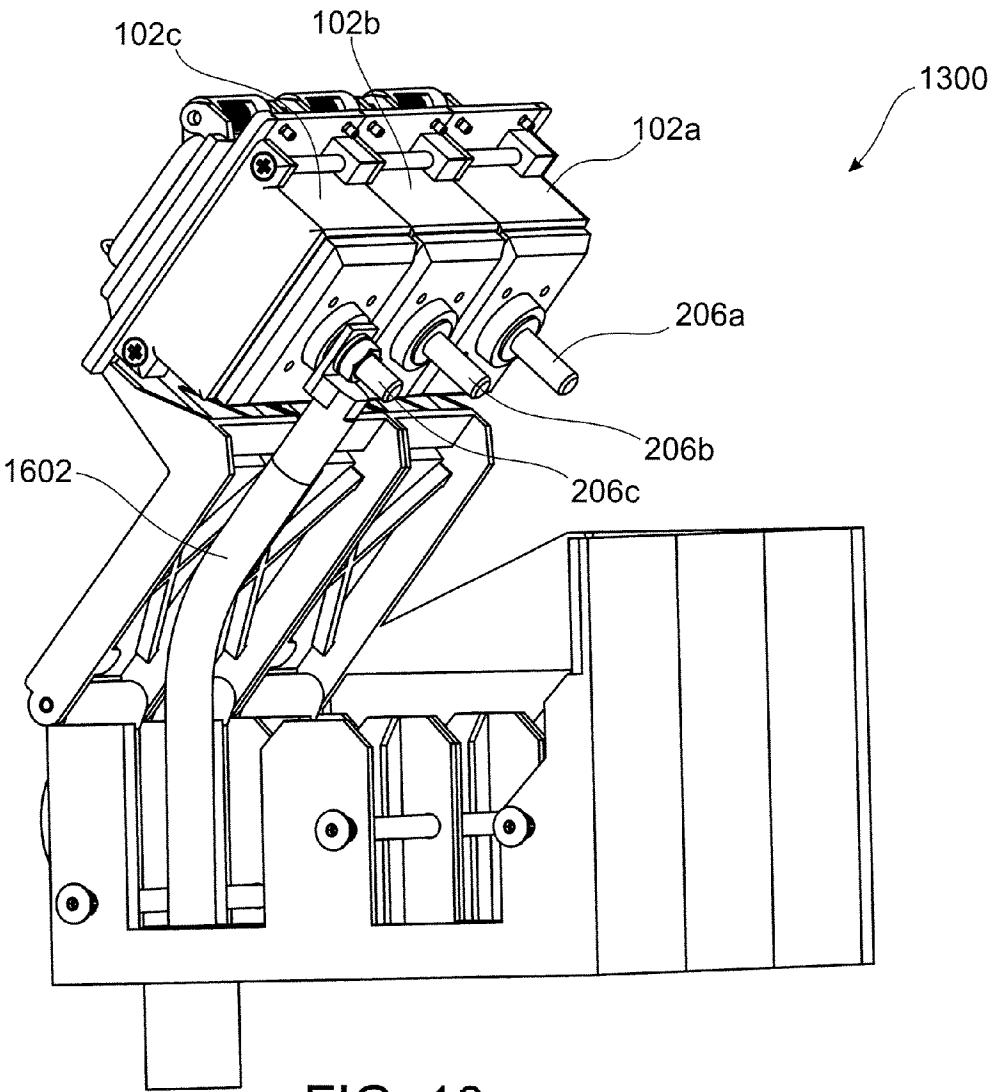
FIG. 16 is a perspective view of the stackable electrical panel assembly from FIG. 15 opened to allow a user to inspect the electrical connection between the electrical panel modules and the power supply according to an exemplary embodiment.
Figure 17:
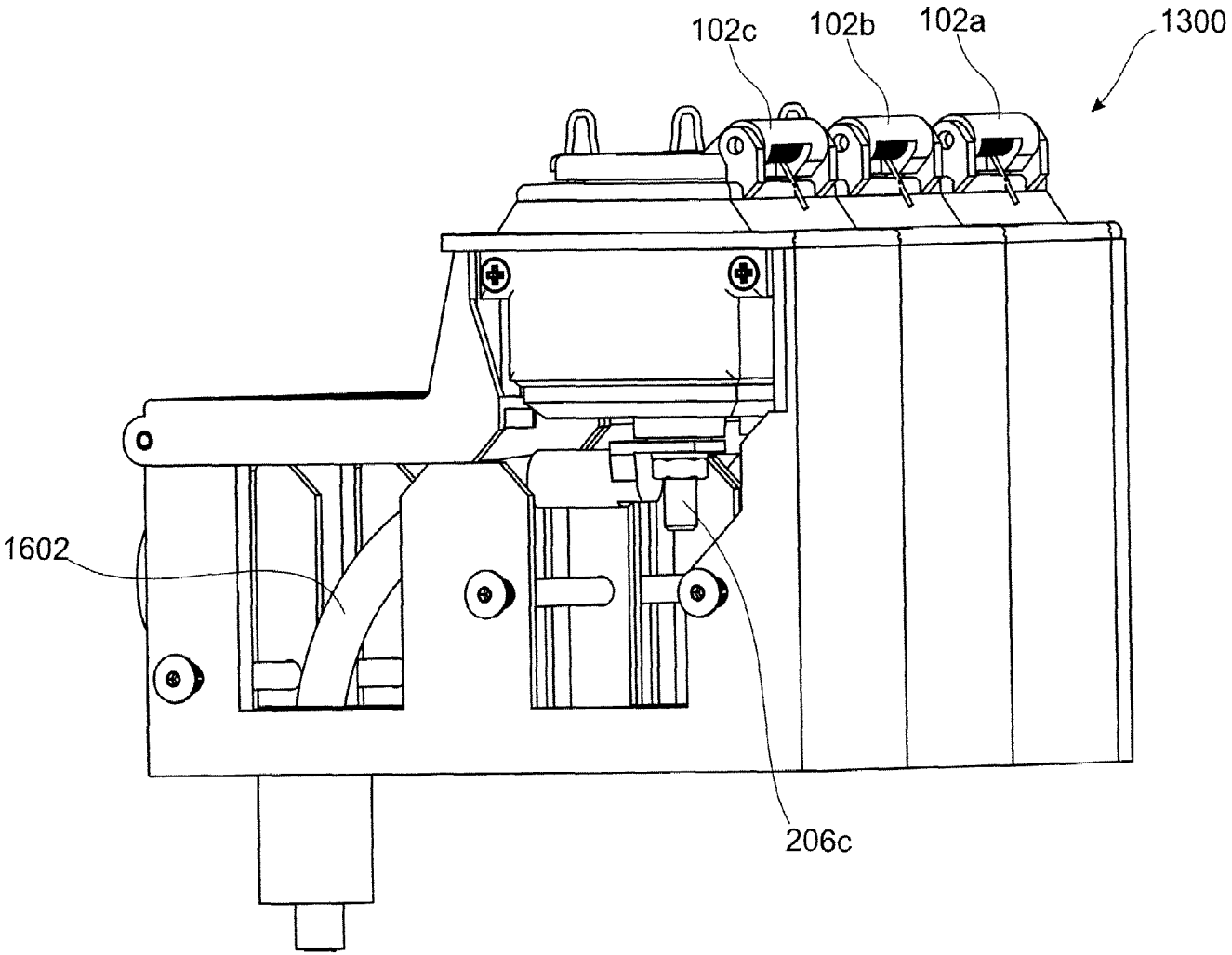
FIG. 17 is a perspective view of the stackable electrical panel assembly from FIG. 15 when closed according to an exemplary embodiment.

FIG. 14A is a perspective view of a housing 1304 of the stackable electrical panels illustrated in FIG. 13 according to an exemplary embodiment. FIG. 14B is a rear elevation view of the housing 1304 of the stackable electrical panel illustrated in FIG. 13 according to an exemplary embodiment. In the exemplary embodiment, the individual electrical modules 102 are mounted on housing 1304 illustrated in FIG. 14A that may be opened to reveal the back portion of the electrical panel modules 102 for inspection or repair. FIG. 15 is front a perspective view of a stackable electrical panel 1300 assembly opened to allow a user to inspect the electrical panel modules 102 according to an exemplary embodiment. FIG. 16 is a rear perspective view of the stackable electrical panel assembly 1300 from FIG. 15 opened to allow a user to inspect the electrical connection 1602 between the electrical panel modules 102 and the power supply according to an exemplary embodiment. FIG. 17 is a perspective view of the stackable electrical panel assembly 1300 from FIG. 16 when closed according to an exemplary embodiment.

Stackable panel assemblies 1300 are assembled in the same manner as the individual electrical panel modules 1302. Each stackable electrical panel 1302 connects to another stackable electrical panel 1302 in such a manner that the electrical power modules can interconnect as previously described. The stackable electrical panel assemblies also can connect in other suitable methods to maintain the disclosed safety features.

Figure 18:
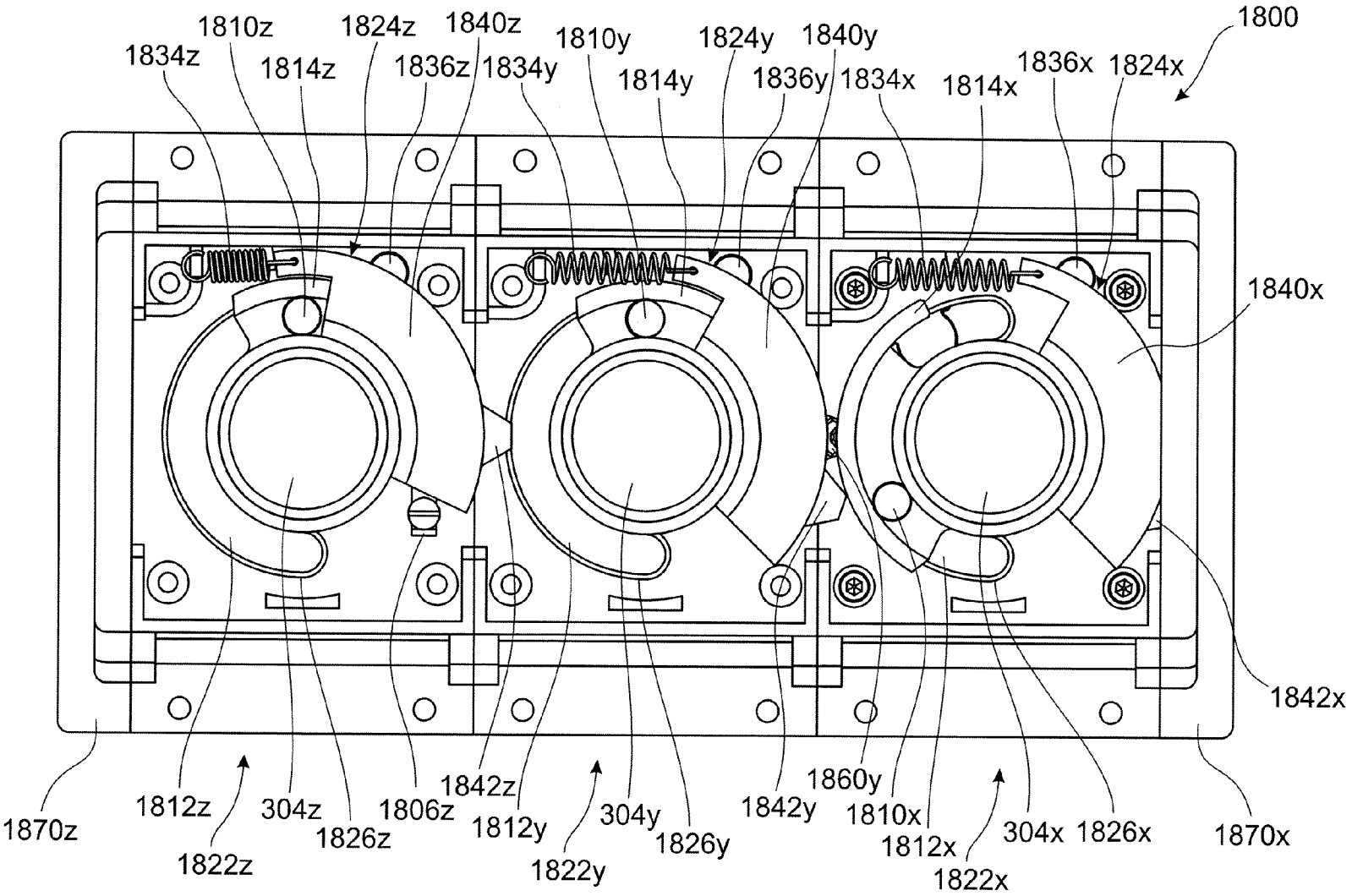
FIG. 18 is a rear perspective view of an electrical panel assembly comprising three interconnected cam electrical panel modules according to an exemplary embodiment.

Alternatives to the previously disclosed apparatus include the use of different mechanisms to practice the apparatus. FIG. 18 is a rear perspective view of an electrical panel assembly 1800 comprising three cam electrical panel modules 1822*x-z* according to an alternative exemplary embodiment.

Elements will be referred to from right to left due to the view being from the rear perspective. Referring to FIG. 1, the rear view of cam electrical panel module 1822*x* corresponds to 102*a*, the rear view of cam electrical panel module 1822*y* corresponds to 102*b*, and the rear view of cam electrical panel module 1822*z* corresponds to 102*c*. A single cam electrical panel module 1822 with elements in first position will be discussed with reference to FIG. 19. The single cam electrical panel module 1822 with elements in second position will be discussed with reference to FIG. 20.

Figure 19:
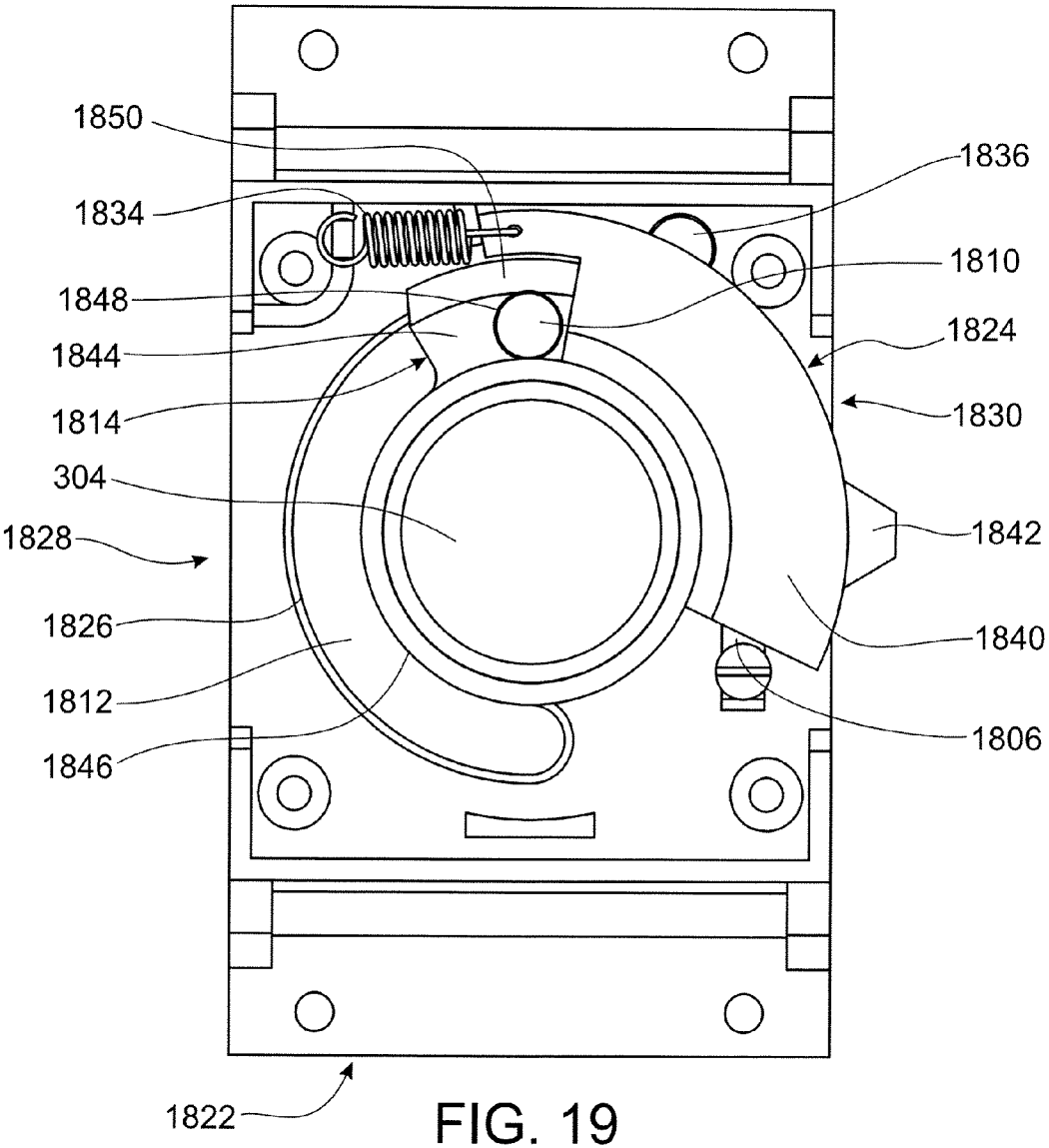
FIG. 19 is a perspective view of a cam electrical module where both a cover cam interlock and a tab cam interlock are in the first position according to an exemplary embodiment.

FIG. 19 is an elevation view of a cam electrical module 1822 where both a cover cam interlock 1824 and a tab cam interlock 1814 are in the first position according to an exemplary embodiment. In the exemplary embodiment, the cover cam interlock 1824 in the first position corresponds to the preceding cam electrical panel module 1822 without a connector installed. A tab cam interlock 1814 in the first position corresponds to a configuration without a connector in the receptacle 302 of the module 1822.

The cover 306 for the cam electrical panel module 1822 is controlled by a cover lock pin 1836. The cover lock pin 1836 in a first position extends toward the cover 306, preventing the cover 306 from opening. A biasing device (not shown) exerts a force to move the cover lock pin 1836 to a second position, where the cover lock pin 1836 is removed from the cover 306 and allows the cover 306 to open.

The cover cam interlock 1824 is freely rotatable around the aperture 304. Referring to FIG. 23, the cover cam interlock 1824 comprises a ring 2306 that operably couples the cover cam interlock 1824 to the module 1822, and a molded cover cam interlock quarter circular component 1840. The cover cam interlock quarter circular component 1840 comprises three physical features. The rear of the cover cam interlock quarter circular component 1840 comprises a tapered surface 2302. As a result of the tapered surface 2302 rotating as part of the cover cam interlock 1824, the distance between the rear of the cover cam interlock 1824 and a fixed point on the surface of the cam electrical module 1822 changes based on the rotation of the cover cam interlock 1824. The tapered surface 2302 allows the cover cam interlock 1824 to apply a force to the cover lock pin 1836 depending on the orientation of the cover cam interlock 1824 with respect to the cover lock pin 1836.

Another feature of the cover cam interlock quarter circular component 1840 includes a concave portion 2304 capable of receiving at least a portion of the tab cam interlock 1814. The concave portion 2304 allows the tab cam interlock 1814 to partially reside behind the cover cam interlock 1824 depending on the position of the rotation ring 1812 and cover cam interlock 1824. Another feature of the cover cam interlock quarter circular component 1840 is a projection 1842. The projection 1842 is designed to extend into the area that may be occupied by the tab cam interlock 1814 of a preceding cam electrical panel module in a cam electrical panel assembly 1800. The projection 1842 may extend outside the cam interlock module 1822 through a cover cam lock aperture 1830 that is substantially similar to the cover lock aperture 430 previously described. The projection 1842 may enter a cam interlock module 1822 though a tab cam interlock aperture 1828 that is substantially similar to the tab interlock aperture 428 previously described.

The cover cam interlock 1824 is normally held in the first position by a biasing element. In the exemplary embodiment, the biasing element is a spring 1834. In an exemplary embodiment, the spring 1834 may be coupled to the cam electrical panel module 1822 by a return spring support, such as a cotter pin. The projection 1842 is designed such that when the tab cam interlock 1814 of a preceding cam electrical panel module 1822 rotates through the area occupied by the projection 1842 when the cover cam interlock 1824 is in the first position, the projection 1842 is acted on and the cover cam interlock 1824 rotates clockwise to the second position in response. Alternatively, the cover cam interlock 1824 may be moved to the second position by a specially constructed side plate with a ground notch designed to place the tab cam interlock 1814 in the second position.

With the cover 306 opened, the connector interacts with the rotation ring 1812 when rotated, which facilitates connections between the transmitting contacts of the module and the receiving contacts of the connector. The rotation ring 1812 comprises a receptacle 302 and a rotation ring tab 1810 that extends in a direction opposite from the direction of the receptacle 302 and is located substantially on the outer diameter of the rotation ring 1812.

Figure 27:
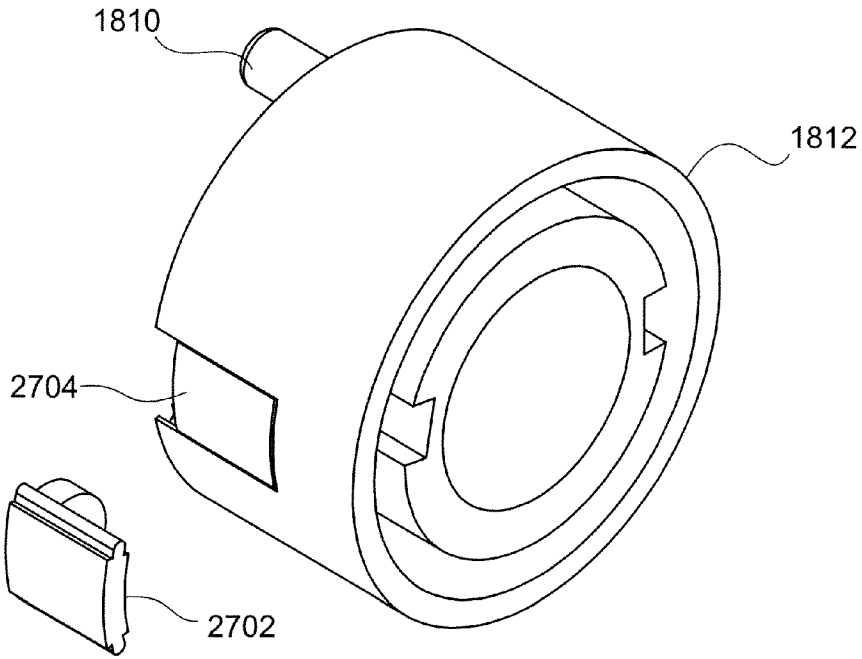
FIG. 27 is an angular perspective view of the rotation ring of FIG. 19 according to an exemplary embodiment.

Referring to FIG. 27, on substantially the opposite side of the rotation ring tab 1810 is a cavity 2704 for holding the internal rotation ring lock 2702. The internal rotation ring lock 2702 is dimensioned to fit in a cavity 2704 of the rotation ring 1812. This cavity 2704 comprises a mechanism to displace the internal rotation ring lock 2702. When the connector is not attached to the receptacle 302, the internal rotation ring lock 2702 is in the first position and extends away from the rotation ring 1812. When in the first position, the internal plug rotate lock 2702 will be partially disposed within the internal plug rotate lock cavity 2704 and prevents the rotation of the rotation ring 1812. When the connector is installed, the internal plug rotate lock 2702 enters the second position and is substantially disposed within the internal plug rotate lock cavity 2704, thereby allowing the rotation ring 1812 to rotate.

The cam electrical panel module 1822 further comprises a tab cam interlock 1814. The tab cam interlock 1814 comprises a ring 1846 and a tab cam interlock quarter circular component 1844 capable of interfacing with the rotation ring 1812. The rotation of the tab cam interlock 1814 is controlled by the rotation of the rotation ring 1812. The tab cam interlock quarter circular component 1844 comprises a rotation ring tab aperture 1848. The rotation ring tab aperture 1848 corresponds to the location or the rotation ring tab 1810, making the tab cam interlock 1814 move in response to the rotation ring 1812. Referring to FIG. 22, the tab cam interlock quarter circular component 1844 further includes a tooth edge 1850 that comprises teeth 2202 at the outer surface of the tooth edge 1850.

Figure 20:
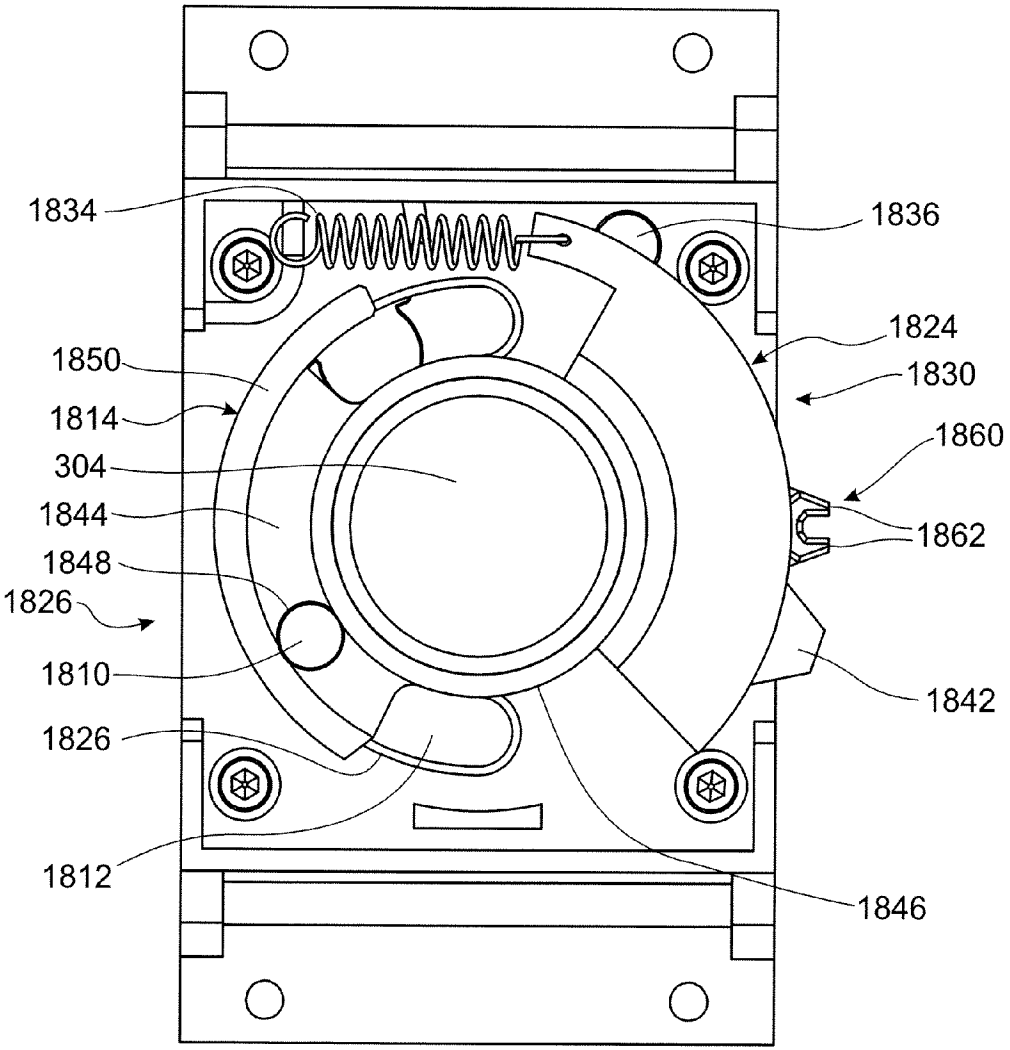
FIG. 20 is a perspective view of the cam electrical module of FIG. 19 where both the cover cam interlock and the tab cam interlock are in the second position according to an exemplary embodiment.
Figure 25:
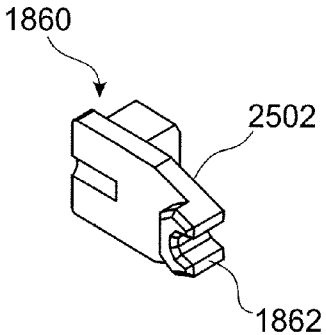
FIG. 25 is an angular perspective view of the external rotation ring lock of FIG. 19 according to an exemplary embodiment.

FIG. 20 is a perspective view of the cam electrical module 1822 of FIG. 19 where both the cover cam interlock 1824 and the tab cam interlock 1814 are in the second position according to an exemplary embodiment. The cam electrical module 1822 is shown as it would be when a connector has been installed, with the cover cam interlock 1824 in the second position and the tab cam interlock 1814 in the second position. Due to the movement of the projection 1842, an external plug rotation ring lock 1860 is visible. The external plug rotation ring lock 1860 comprises external plug rotate lock teeth 1862 that correspond to the teeth 2202 in the tab cam interlock 1814. Referring to FIG. 25, the external plug rotation ring lock 1860 also comprises a surface 2502 that may be acted on by the internal rotation ring lock 2702. The external plug rotating ring lock 1860 alternates between a first position and a second position. When the external plug rotation lock 1860 is in first position, it lies in a plane that is different from the plane occupied by the teeth 2202 of a tab cam interlock 1814. When the rotation ring 1812 acts on the internal rotation ring lock 2702, the internal rotation ring lock 2702 exerts a force on the external plug rotation ring lock 1860, moving the external plug rotation ring lock 1860 into the second position that corresponds to the plane occupied by the teeth 2202 of the tab cam interlock 1814. The external plug rotate lock teeth 1862 from the external plug rotation ring lock 1860 and the tab cam interlock 1814 mesh together when the plug rotation ring lock 1860 is engaged. The interface between the external plug rotate lock 1860 and the tab cam interlock 1814 allows the rotation ring 1812 to be locked in the second position when the external plug rotate lock 1860 is engaged.

Figure 21:
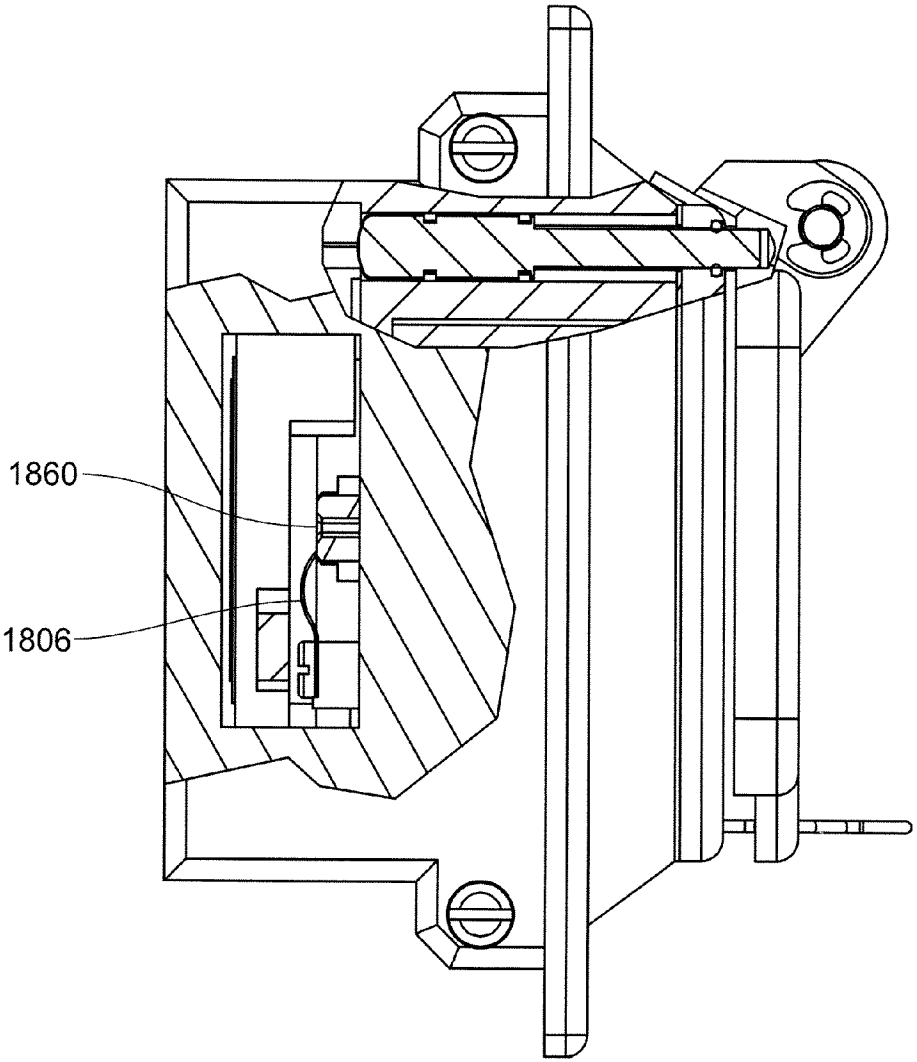
FIG. 21 is a side perspective view of an external rotation ring lock attached to the spring when in the first position according to an exemplary embodiment.

FIG. 21 is a top view of the external plug rotation ring lock 1860 attached to a hold down spring 1806 when in the first position according to an exemplary embodiment. The external plug rotation ring lock 1860 as shown in FIG. 21 is held in the first position by a hold down spring 1806. The biasing force of the hold down spring 1806 pushes the external plug rotation ring lock 1860 towards the cover 306. When a connector is inserted into the receptacle 302, the biasing force of the hold down spring 1806 is overcome and the external plug rotation ring lock 1860 is moved into the second position away from the cover 306.

Figure 28:
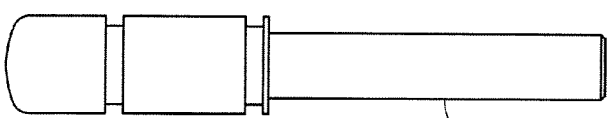
FIG. 28 is a side elevation view of the cover lock pin according to an exemplary embodiment.
Figure 26:
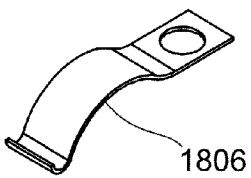
FIG. 26 is an angular perspective view of the external rotation ring lock spring according to an exemplary embodiment of FIG. 19 according to an exemplary embodiment.

FIGS. 22-28 illustrate various individual elements of the cam electrical panel modules 1822 components discussed in the previous paragraphs. FIG. 22 is an angular perspective view of the tab cam interlock 1814 of FIG. 19 according to an exemplary embodiment. FIG. 23 is an angular perspective view of the cover cam interlock 1824 of FIG. 19 according to an exemplary embodiment. FIG. 24 is an angular perspective view of a spacer 2402 of FIG. 19 according to an exemplary embodiment. The spacer 2402 is used to fill the space between the cover cam interlock 1824 and other sections of the cam electrical panel module 1822. FIG. 25 is an angular perspective view of the external plug rotation ring lock 1860. FIG. 26 is an angular perspective view of the external rotation ring lock spring 1806 of FIG. 19 according to an exemplary embodiment. FIG. 27 is an angular perspective view of the rotation ring 1812 in the exemplary embodiment of FIG. 19 according to an exemplary embodiment. FIG. 28 is a side elevation view of the cover lock pin 1836. In the exemplary embodiment, the first end is designed to interface with the cover 306 and the second end is designed to interface with the tapered surface 2302 of the tab cam interlock 1814.

Based on the previous descriptions of the various elements of the cam electrical panel modules 1822, the following exemplary embodiment illustrates how the multiple cam electrical panel modules 1822 form a cam electrical panel assembly 1800 as previously shown in FIG. 18. Three cam electrical panel modules 1822*x-z* are assembled to form a cam electrical panel assembly 1800. Side plates 1870*x*, 1870*z* are attached to the leading edge of cam electrical panel module 1822*x* and the trailing edge of cam electrical panel module 1822*z*, respectively. The side plate 1870*x* attached to cam electrical panel module 1822*x* comprises a cam ground notch that is substantially similar to the previously described ground notch 906 and mimics a tab cam interlock 1824 of a preceding module in the second position, thereby holding cover cam interlock 1824*x* in the second position and allowing the cover lock pin 1836 to withdraw from the cover 306*x*.

Cam electrical panel module 1822*x* has the cover cam interlock 1824*x* in the second position. Rotation of the cover cam interlock 1824*x* causes the tapered surface 2302*x* of the cover cam interlock 1824*x* to allow the biasing device acting on the cover lock pin 1836*x* to withdraw the cover lock pin 1836*x* from the cover 306*x*. The cover 306*x* may be opened, and a connector may be inserted into the receptacle 302*x*, applying a lateral force on the rotation ring 1812*x*. The lateral force moves rotation ring 1812*x* in a direction of the internal rotation ring lock 2702*x*. The rotation ring 1812*x*, internal rotation ring lock 2702*x*, and external plug rotation ring lock 1860*x* are adjacent to each other in such a manner that when the rotation ring 1812*x* moves in a lateral direction, the space between the rotation ring 1812*x*, internal rotation ring lock 2702*x*, and external plug rotation ring lock 1860*x* contact each other. As a result of this relationship, when the connector is completely inserted, the connector forces the internal rotation ring lock 2702*x* to press against the external plug rotation ring lock 1860*x*. The result is that external plug rotation ring lock 1860*x* is moved to the second position. Additionally, the internal rotation ring lock 2702*x* is in the second position, which corresponds to becoming substantially housed in the internal plug rotate lock into the cavity 2702*x* of the rotation ring 1812*x*.

With the internal rotation ring lock 2702*x* in the second position, the rotation ring 1812*x* is now freely rotatable. When rotated, the connector applies a rotational force to move the rotation ring 1812*x* into a second position. The second position is reached when the transmitting contacts of the module are in contact with the receiving contacts of the connector. Alternatively, the contacts be contact each other prior to fully reaching the second position. The tab cam interlock 1814*x* rotates with the rotation ring 1812*x* due to the action of the rotation ring tab 1810*x* through the rotation ring channel 1826*x* that is operably coupled to the tab cam interlock 1814*x* via the rotation ring tab aperture 1848*x*. In an exemplary embodiment, the configuration of the tab cam interlock teeth 2202 are designed to correspond with the location where the transmitting and receiving contacts are operably coupled.

The installation of the connector in cam electrical panel module 1822*x* affects cam electrical panel module 1822*y*. The projection 1842*y* from the cover cam interlock 1824*y* of cam electrical panel module 1822*y* extends into cam electrical panel module 1822*x* via the cover cam interlock aperture 1830*y* of cam electrical panel module 1822*y* and the tab cam interlock aperture 1828*x* of cam electrical panel module 1822*x*. When the tab cam interlock 1814*x* of cam electrical panel module 1822*x* reaches the second position, the tab cam interlock 1814*x* of cam electrical panel module 1822*x* displaces the cover cam interlock 1824*y* of cam electrical panel module 1822*y*, thereby rotating the cover cam interlock 1824*y* of cam electrical panel module 1822*y* into the second position.

With the cover cam interlock 1824*y* of cam electrical panel module 1822*y* in the second position, the tapered surface 2302*y* of the tab cam interlock 1814*y* allows the biasing device acting on the cover lock pin 1836*y* to withdraw the cover lock pin 1836*y* from the cover 306*y*. The cover 306*y* may be opened and a connector may be inserted into the receptacle 302*y*. The connector applies a lateral force on rotation ring 1812*y*. The lateral force moves rotation ring 1812*y* in a direction of internal rotation ring lock 2702*y*. The rotation ring 1812*y*, internal rotation ring lock 2702*y*, and external plug rotation ring lock 1860*y* are adjacent to each other in such a manner that when the rotation ring 1812*y* moves in a lateral direction, the space between the rotation ring 1812*y*, internal rotation ring lock 2702*y*, and external plug rotation ring lock 1860*y* contact each other. As a result of this relationship, when the connector is completely inserted, the connector forces the internal rotation ring lock 2702*y* to press against the external plug rotation ring lock 1860*y*. The result is that external plug rotation ring lock 1860*y* is moved to the second position. Additionally, the internal rotation ring lock 2702*y* is in the second position, which corresponds to becoming substantially housed in With the external plug rotation ring lock 1860*y* in the second position, the external plug rotate lock teeth 1862*y* of the external plug rotation ring lock 1860*y* now interact with the tab cam interlock teeth 2202*x* of the cover cam interlock 1824*x* of cam electrical panel module 1822*x*. With the external plug rotate lock teeth 1862*y* of the external plug rotation ring lock 1860*y* unable to rotate, the tab cam interlock 1814*x* of cam electrical panel module 1822*x* is fixed in position, preventing the rotation ring 1812*x* of cam electrical panel module 1822*x* from rotating to release the connector. This feature allows cam electrical panel module 1822*y* to fix the connectors of cam electrical panel module 1822*x* in position, regardless of the actual position of the connector in the cam electrical panel module 1822*x*.

With the internal rotation ring lock 2702*y* of cam electrical panel module 1822*y* in the second position, the rotation ring 1812*y* is freely rotatable. When rotated, the connector applies a rotational force to move the rotation ring 1812*y* into a second position. The second position is reached when the transmitting contacts of the cam electrical panel module 1822*y* are in contact with the receiving contacts of the connector. Alternatively, the contacts be contact each other prior to fully reaching the second position. The tab cam interlock 1814*y* rotates with the rotation ring 1812*y* due to the action of the rotation ring tab 1810*y* through the rotation ring channel 1826*y* that is operably coupled to the tab cam interlock 1814*y* via the rotation ring tab aperture 1848*y*.

The installation of the connector in cam electrical panel module 1822*y* affects cam electrical panel module 1822*z*. The cover cam interlock projection 1842*z* extends into cam electrical panel module 1822*y* via the tab cam interlock aperture 1828*z* of cam electrical panel module 1822*z* and the cover cam interlock aperture 1830*y* of cam electrical panel module 1822*y*. When the tab cam interlock 1814*y* of cam electrical panel module 1822*y* reaches the second position, the tab cam interlock 1814*y* of cam electrical panel module 1822*y* displaces the cover cam interlock 1824*z* of cam electrical panel module 1822*z*, rotating the cover cam interlock 1824*z* of cam electrical panel module 1822*z* into the second position.

With the cover cam interlock 1824*z* of cam electrical panel module 1822*z* in the second position, the tapered surface 2302*z* of the cover cam interlock 1824*z* allows the biasing device acting on the cover lock pin 1836*z* to withdraw the cover lock pin 1836*z* from the cover 306*z*. The cover 306*z* may be opened and a connector may be inserted into the receptacle 302*z*. The connector applies a lateral force on rotation ring 1812*z*. The lateral force moves the rotation ring 1812*z* in a direction of internal rotation ring lock 2702*z*. When completely inserted, the connector forces the internal rotation ring lock 2702*z* to press against external plug rotation ring lock 1860*z*. The result is that the internal rotation ring lock 2702*z* is in the second position, which corresponds to becoming substantially housed in the internal plug rotate lock cavity 2704*z* of the rotation ring 1812*z*. Additionally, the external plug rotation ring lock 1860*z* is now in a second position.

With the external rotation ring lock 1860*z* in the second position, the external plug rotate lock teeth 1862*z* of the external plug rotation ring lock 1860*z* now interact with the tab cam interlock teeth 2202*y* of the tab cam interlock 1814*y* of cam electrical panel module 1822*y*. With the external plug rotate lock teeth 1862*z* of the external plug rotation ring lock 1860*z* unable to rotate, the tab cam interlock 1814*y* of cam electrical panel module 1822*y* is fixed in position, preventing the rotation ring 1812*y* of cam electrical panel module 1822*y* from rotating to release the connector. This feature allows the cam electrical panel module 1822*z* to fix the connectors of the cam electrical panel module 1822*y* in position, regardless of the actual position of the connector in cam electrical panel module 1822*y*.

To disconnect connectors from the modules, the connectors are decoupled from receptacles 302 in reverse order. In the exemplary embodiment, the tab cam interlock 1814*z* of cam electrical panel module 1822*z* is not fixed in position, allowing the rotation ring 1812*z* to freely rotate. The connector is rotated, causing the rotation ring 1812*z* to return to the first position where the connector is removed. When the connector is removed from cam electrical panel module 1822*z*, the lateral force acting on the rotation ring 1812*z* is removed, causing the external plug rotation ring lock 1860*z* and internal rotation ring lock 2702*z* to return to the first position. With internal rotation ring lock 2702*z* in the first position, the rotation ring 1812*z* is locked in the first position. With the external plug rotation ring lock 1860*z* in the first position, the external plug rotate lock teeth 1862*z* of external plug rotation ring lock 1860*z* are disengaged from the tab cam interlock 1814*y* of cam electrical panel module 1822*y*.

With the release of the external rotation ring lock teeth 1862*z* from the tab cam interlock 1814*y* from cam electrical panel module 1822*y*, the rotation ring 1812*y* is freely rotatable. The connector is rotated, causing the rotation ring 1812*y* to return to the first position where the connector is removed. Additionally, the return of the rotation ring 1812*y* to the first position causes the tab cam interlock 1814*y* to move to the first position. With the tab cam interlock 1814*y* of cam electrical panel module 1822*y* in the first position, the tab cam interlock 1814*y* no longer acts on the cover cam interlock 1824*z* of cam electrical panel module 1822*z*. The cover cam interlock 1824*z* of cam electrical panel module 1822*z* returns to the first position where the tapered surface 2302*z* of the cover cam interlock 1824*z* acts on the cover lock pin 1836*z* to overcome the biasing device. With the biasing force overcome, the cover lock pin 1836*z* enters the cover 306*z*, preventing the cover 306*z* from being opened.

When the connector is removed from cam electrical panel module 1822*y*, the lateral force acting on the rotation ring 1812*y* is removed, causing the external plug rotation ring lock 1860*y* and internal rotation ring lock 2702*y* to return to the first position. With internal rotation ring lock 2702*y* in the first position, the rotation ring 1812*y* is locked in the first position. With the external plug rotation ring lock 1860*y* in the first position, the external plug rotate lock teeth 1862*y* of external plug rotation ring lock 1860*y* are disengaged from the tab cam interlock 1814*x* of cam electrical panel module 1822*x*.

With the release of the external rotation ring lock teeth 1862*y* from the tab cam interlock 1814*x* from cam electrical panel module 1822*x*, the rotation ring 1812*x* is freely rotatable. The connector is rotated, causing the rotation ring 1812*x* to return to the first position where the connector is removed. Additionally, the return of the rotation ring 1812*x* to the first position causes the tab cam interlock 1814*x* to move to the first position. With the tab cam interlock 1814*x* of cam electrical panel module 1822*x* in the first position, the tab cam interlock 1814*x* no longer acts on the cover cam interlock 1824*y* of cam electrical panel module 1822*y*. The cover cam interlock 1824*y* of cam electrical panel module 1822*y* returns to the first position where the tapered surface 2302*y* of the cover cam interlock 1824*y* acts on the cover lock pin 1836*y* to overcome the biasing device. With the biasing force overcome, the cover lock pin 1836*y* enters the cover 306*y*, preventing the cover 306*y* from being opened.

When the connector is removed from cam electrical panel module 1822*x*, the lateral force acting on the rotation ring 1812*x* is removed, causing the external plug rotation ring lock 1860*x* and internal rotation ring lock 2702*x* to return to the first position. With internal rotation ring lock 2702*x* in the first position, the rotation ring 1812*x* is locked in the first position.

Due to the use of the side plate, the cover cam interlock 1824*x* remains in the second position. As a result, the cover lock pin 1836*x* does not enter the cover 306*x*, allowing the cover 306*x* to be opened and a connector to be inserted.

Figure 29:
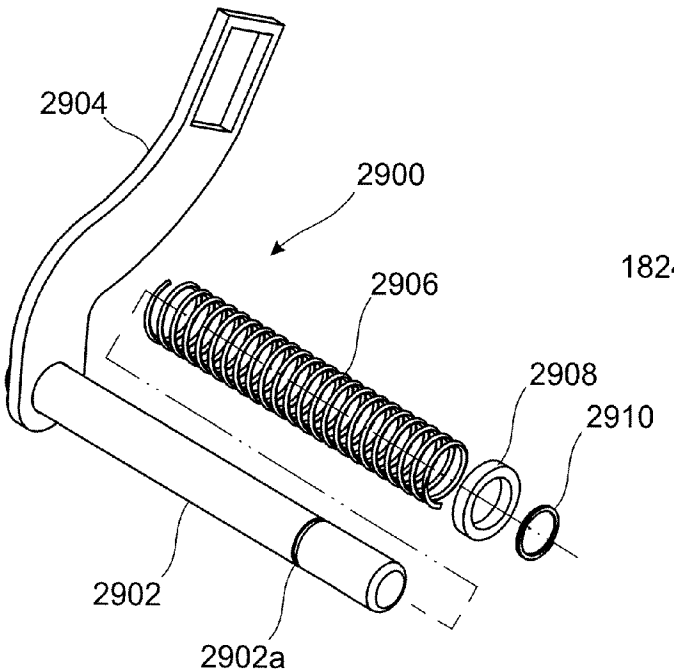
FIG. 29 is an angular perspective view of a modified cover lock pin according to an exemplary embodiment.

FIG. 29 is an angular perspective view of a modified cover lock pin 2900 according to an exemplary embodiment. The modified cover lock pin 2900 accomplishes substantially the same function as the previously-described cover lock pin 1836 except as follows: An alternative embodiment of the cam electrical panel module 1822 uses the modified cover lock pin 2900 to interact with the external plug rotation ring lock 1860 to fix a connector in a previous cam electrical panel module 1822. The modified cover lock pin 2900 comprises a pin 2902 and a lift plate 2904 coupled to one end of the pin 2902. A spring 2906 is disposed around the pin 2902. A plate washer 2908 holds the spring 2906 in position, and the ring member 2910 is disposed in a groove 2902*a* of the pin 2902 to hold the spring 2906 and the plate washer 2908 in position on the pin 2902.

Figure 30:
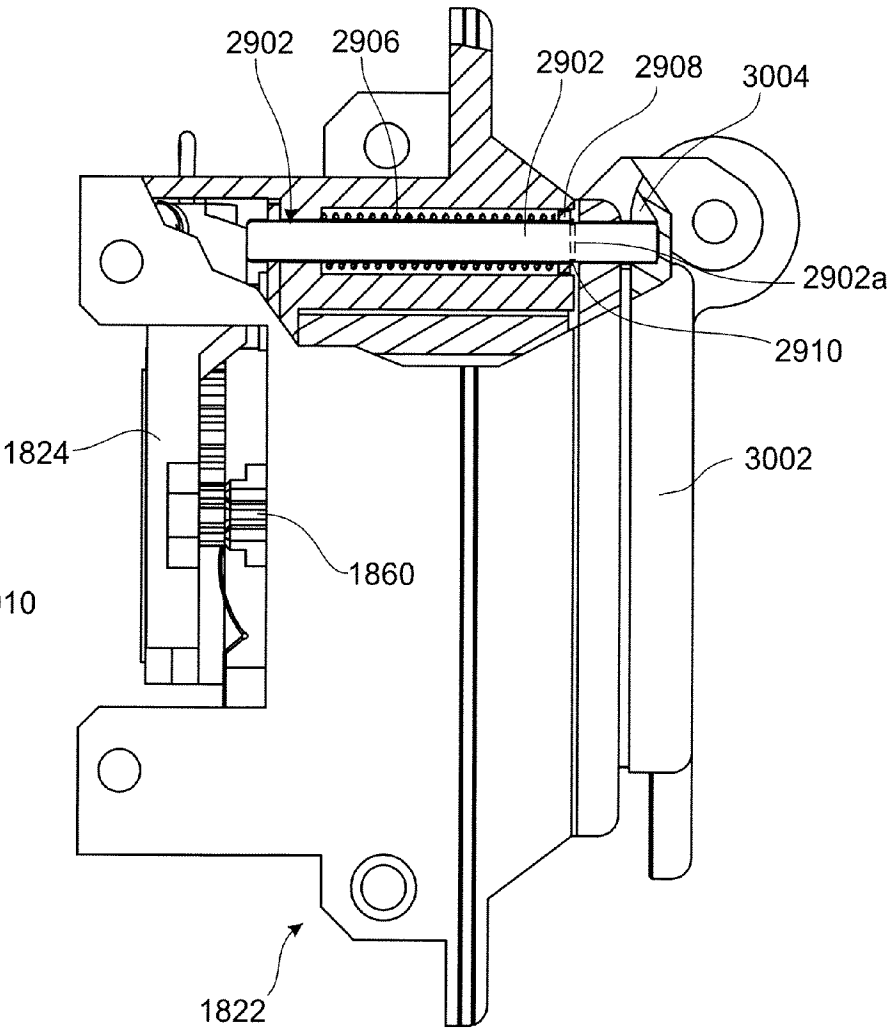
FIG. 30 is a side perspective view of a cam electrical panel module with a modified cover in a closed position according to an exemplary embodiment.

FIG. 30 is a side perspective view of a cam electrical panel module 1822 utilizing the lock pin 2900 and having a modified cover 3002 in a closed position according to an exemplary embodiment. The lock pin 2900 is disposed within a bore 3006 of the module 1822. In first position, the lock pin 2900 is biased to rest as shown in FIG. 30, with the pin 2902 engaged with the modified cover 3002. When the cover cam interlock 1824 is in first position, the lock pin 2900 is in first position, the concave portion 2304 of the cover cam interlock 1824 prevents movement of the pin 2902 into the module 1822, and the cover 3002 is closed. Additionally, the lift plate 2904 is disposed adjacent to the external plug rotation ring lock 1860.

The lock pin 2900 is biased to project into the modified cover 3002. The modified cover 3002 compromises a tapered surface 3004 that is dimensioned to accept the lock pin 2900 while still allowing the modified cover 3002 to open. When the modified cover 3002 is closed, the modified cover lock pin 2900 projects into the modified cover 3002 via the biasing force of the spring 2906, thereby keeping the modified cover lock pin in first position.

Figure 31:
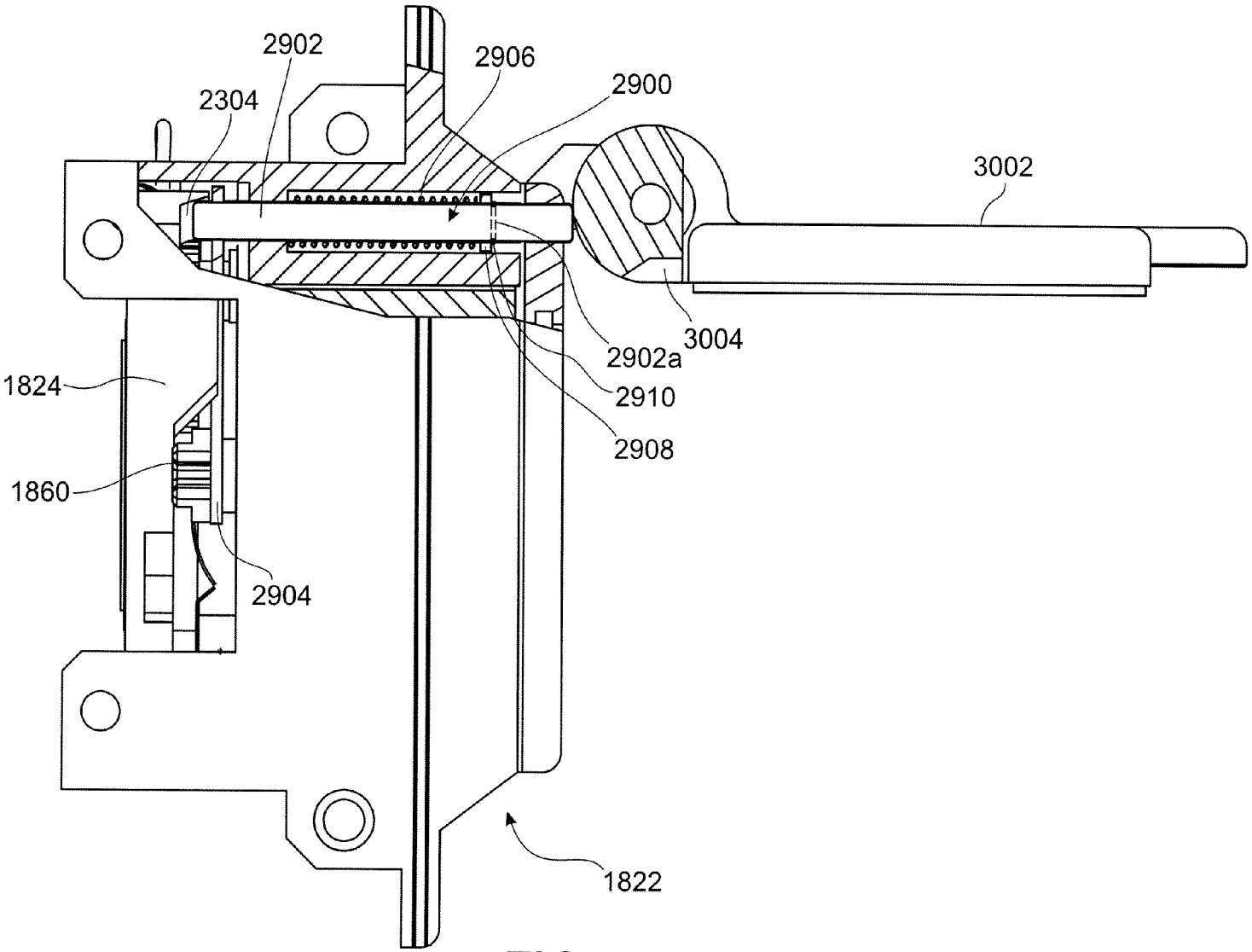
FIG. 31 is a side perspective view of a cam electrical panel module with a modified cover in an open position according to an exemplary embodiment.

FIG. 31 is a side perspective view of a cam electrical panel module 1822 with the modified cover 3002 in an open position according to an exemplary embodiment. As shown in FIG. 31 the cover cam interlock 1824 has been moved to second position by insertion of a connector (not shown) into a preceding module (not shown). Moving the cover cam interlock 1824 to second position causes the concave portion 2304 of the cover cam interlock 1824 to be disposed adjacent to the pin 2902, thereby allowing movement of the pin 2902 into the module 1822. As the cover 3002 is opened, the tapered portion 3004 of the cover 3002 (and then an external, circular portion of the cover) acts on the pin 2902 to push the pin 2902 against the bias force of the spring 2906 and into the module 1822. Accordingly, the lock pin 2900 is illustrated in second position in FIG. 31. As the lock pin 2900 moves to second position, the lift plate 2904 now acts on the external plug rotation ring lock 1860, moving the external plug rotation ring lock 1860 into second position. As previously discussed, with the external plug rotation ring lock 1860 of a module 1822 in second position, the external plug rotation ring lock teeth 1862 act on the tab cam interlock teeth 2202 of the preceding module, thereby fixing the tab cam interlock 1814 of the preceding module in position. The lift plate 2904 will continue to act on the external plug rotation ring lock 1860 until the modified cover lock pin 2900 returns to first position, which can only occur when the cover 3002 is closed. As a result, a connector cannot be removed from a proceeding module if the subsequent module 1822 in series still has the cover 3002 open.

An additional feature involves the use of alternative tongue and seal grooves using a tongue with a tapered lead in a groove with a square bottom. A filling tube similar to an O ring fits between the tongue and groove and conforms to that square when the modules are assembled.

Therefore, the present disclosed apparatus is well adapted to attain the ends and advantages mentioned as well as those that are inherent therein. The particular embodiments disclosed above are illustrative only, as the presently disclosed apparatus may be modified and practiced in different but equivalent manners apparent to those having ordinary skill in the art and having the benefit of the teachings herein. Having described some exemplary embodiments of the presently disclosed apparatus, it is believed that various modifications are within the purview of those in the art without departing from the scope and spirit of the invention. While numerous changes may be made by those having ordinary skill in the art, such changes are encompassed within the spirit of the disclosed apparatus as defined by the appended claims. Furthermore, no limitations are intended to the details of construction or design herein shown, other than as described in the claims below. It is therefore evident that the particular exemplary embodiments disclosed above may be altered or modified and all such variations are considered within the scope and spirit of the present disclosed apparatus. The terms in the claims have their plain, ordinary meaning unless otherwise explicitly and clearly defined by the patentee.

What is claimed is:

1. An electrical panel assembly, comprising:

a first electrical panel module, a second electrical panel module, and an end cap covering an end of one of said electrical panel modules, wherein said end is not connected to another electrical panel module;

wherein said first module comprises:

a first receptacle disposed in said first module; and a first rotating ring, wherein said first rotating ring is rotatable between an open position permitting connection or disconnection of a first connector from said first receptacle and a closed position preventing connection or disconnection of the first connector from said first receptacle, wherein said second module comprises a second receptacle disposed in said second module, and wherein said first electrical panel module interacts with said second electrical panel module such that absent connection of the first connector in said first receptacle of said first module, a second connector cannot be inserted into said second receptacle of said second module.

2. The electrical panel assembly of claim 1, wherein said first electrical panel module further comprises:

a first module tab interlock; and a first module tab interlock aperture, wherein the first module tab interlock is in a first position when said first rotating ring is in the open position, wherein said first module tab interlock is in a second position when said first rotating ring is in the closed position.

3. The electrical panel assembly of claim 2, said second electrical panel module further comprising:

a second rotating ring wherein said second rotating ring is rotatable between an open position permitting connection or disconnection of a second connector from a second receptacle and a closed position preventing connection or disconnection of the second connector from said second receptacle;

a second module cover interlock; and a second module cover interlock aperture, wherein the second module cover interlock is in a first position when said first module tab interlock is in first position and locks the second rotating ring, wherein said second module cover interlock is in a second position when said first module tab interlock is in second position and unlocks said second rotating ring; and wherein the connection between the second connector and said second receptacle restricts said second module cover interlock, thereby fixing a first module cover interlock to prevent disconnection of the first connector from said first receptacle.

4. The electrical panel assembly of claim 3, wherein said second electrical panel module further comprises:

a second module tab interlock; and a second module tab interlock aperture, wherein said second module tab interlock is in a first position when said second rotating ring is in an open position, and wherein said second module tab interlock is in a second position when said second rotating ring is in the closed position.

5. The electrical panel assembly of claim 4, further comprising:

a third electrical panel module comprising:

a third rotating ring wherein said third rotating ring is rotatable between an open position permitting connection or disconnection of a third connector from said third receptacle and a closed position preventing connection or disconnection of the third connector from said third receptacle;

a third module cover interlock; and a third module cover interlock aperture, wherein the third module cover interlock is in a first position when said third module tab interlock is in its first position and locks the third rotating ring, wherein said third module cover interlock is in a second position when said second module tab interlock is in its second position and unlocks said third rotating ring, and wherein the connection between the third connector and said third receptacle restricts said third module cover interlock, thereby fixing said second module cover interlock to prevent disconnection of the second connector from the second receptacle.

6. The electrical panel assembly of claim 5, wherein said third electrical panel module further comprises a third module tab interlock, wherein said third module tab interlock is in a first position when said third rotating ring is in an open position, and wherein said third module tab interlock is in a second position when said third rotating ring is in the closed position.

7. The electrical panel assembly of claim 1, further comprising a door to cover said first receptacle.

8. The electrical panel assembly of claim 7, further comprising:

a door locking jam link having an open position allowing said door to open and a close position preventing said door from opening, wherein the door locking jam link is connected to a first cover interlock.

9. An electrical panel assembly, comprising:

a first electrical panel module, a second electrical panel module, and an end cap covering an end of one of said electrical panel modules, wherein said end is not connected to another electrical panel module;

where said first module comprises:

a first receptacle disposed in said first module; and a first locking device, wherein said first locking device is movable between an unlocked position permitting connection or disconnection of a first connector from said first receptacle and a locked position preventing connection or disconnection of the first connector from said first receptacle, where said second module comprises a second receptacle disposed in said second module, and wherein said first electrical panel module interacts with said second electrical panel module such that absent connection of the first connector in said first receptacle of said first module, a second connector cannot be inserted into said second receptacle of said second module.

10. The electrical panel assembly of claim 1, further comprising a limit switch affixed to an external casing of said at least one electrical panel module.

11. The electrical panel assembly of claim 1, further comprising a flange seal coupled to the front of said electrical panel assembly.

12. The electrical panel assembly of claim 1, further comprising a casing in which said first electrical panel module is disclosed, wherein said casing provides independent structural support to said first electrical panel module, and wherein said casing provides access to said first electrical panel module.

13. An electrical panel module, comprising:

a first module casing designed to link with a second module casing in series;

a first receptacle disposed in said first module casing;

a first rotating ring wherein said first rotating ring is rotatable between an open position permitting connection or disconnection of a first connector from said first receptacle and a closed position preventing connection or disconnection of the first connector from said first receptacle; and a first tab interlock to interface with a second module casing;

wherein said second module casing comprises a second receptacle disposed in said second module casing; and wherein said first module casing contains one or more openings to facilitate internal interconnectivity with said second module casing via said first tab interlock.

14. An electrical panel module of claim 13, further comprising:

a second cover interlock of said second module casing to interface with said first tab interlock in the first electrical power module;

wherein said first tab interlock starts in a first position;

wherein connection between said first connector and said first receptacle acts on said first tab interlock to move said first tab interlock to a second position;

wherein said second module casing contains one or more openings to facilitate internal interconnectivity with said first module casing; and wherein a connection between a second connector and a second receptacle restricts the second cover interlock, fixing said first rotating ring of the first module casing to prevent said first electrical panel module from disconnecting said first connector.

15. The electrical panel assembly of claim 9, wherein said first electrical panel module further comprises:

a first module tab interlock; and a first module tab interlock aperture, wherein the first module tab interlock is in a first position when said first locking device is in the unlocked position, wherein said first module tab interlock is in a second position when said first locking device is in the locked position.

16. The electrical panel assembly of claim 15, wherein said second electrical panel module further comprises:

a second locking device, wherein said second locking device is movable between an unlocked position permitting connection or disconnection of a second connector from a second receptacle and a locked position preventing connection or disconnection of the second connector from said second receptacle;

a second module cover interlock; and a second module cover interlock aperture, wherein the second module cover interlock is in a first position when said first module tab interlock is in first position and locks the second locking device, wherein said second module cover interlock is in a second position when said first module tab interlock is in second position and unlocks said second locking device; and wherein the connection between the second connector and said second receptacle restricts said second module cover interlock, thereby fixing a first module cover interlock to prevent disconnection of the first connector from said first receptacle.

17. The electrical panel assembly of claim 16, wherein said second electrical panel module further comprises:

a second module tab interlock; and a second module tab interlock aperture, wherein said second module tab interlock is in a first position when said second locking device is in an unlocked position, and wherein said second module tab interlock is in a second position when said second locking device is in the locked position.

18. The electrical panel assembly of claim 17, further comprising:

a third electrical panel module comprising:

a third locking device wherein said third locking device is movable between an unlocked position permitting connection or disconnection of a third connector from said third receptacle and a locked position preventing connection or disconnection of the third connector from said third receptacle;

a third module cover interlock; and a third module cover interlock aperture, wherein the third module cover interlock is in a first position when said third module tab interlock is in its first position and locks the third locking device, wherein said third module cover interlock is in a second position when said second module tab interlock is in its second position and unlocks said third locking device, and wherein the connection between the third connector and said third receptacle restricts said third module cover interlock, thereby fixing said second module cover interlock to prevent disconnection of the second connector from the second receptacle.

19. The electrical panel assembly of claim 18, wherein said third electrical panel module further comprises a third module tab interlock, wherein said third module tab interlock is in a first position when said third locking device is in an unlocked position, and wherein said third module tab interlock is in a second position when said third locking device is in the locked position.

* * * * *